US009031484B2

(12) United States Patent
Tsueda et al.

(10) Patent No.: US 9,031,484 B2
(45) Date of Patent: May 12, 2015

(54) FUSER, IMAGE FORMING APPARATUS, AND IMAGE FORMING METHOD

(75) Inventors: Yoshinori Tsueda, Shizuoka (JP); Satoshi Kinouchi, Tokyo (JP); Ryota Saeki, Shizuoka (JP); Toshihiro Sone, Kanagawa (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 135 days.

(21) Appl. No.: 13/490,967

(22) Filed: Jun. 7, 2012

(65) Prior Publication Data

US 2013/0004218 A1 Jan. 3, 2013

Related U.S. Application Data

(60) Provisional application No. 61/502,304, filed on Jun. 28, 2011, provisional application No. 61/502,309, filed on Jun. 28, 2011.

(51) Int. Cl.
*G03G 15/20* (2006.01)

(52) U.S. Cl.
CPC ..... *G03G 15/2032* (2013.01); *G03G 15/206* (2013.01); *G03G 15/2067* (2013.01); *G03G 15/2089* (2013.01); *G03G 2215/2038* (2013.01); *G03G 15/2017* (2013.01); *G03G 15/2064* (2013.01)

(58) Field of Classification Search
CPC ..... G03G 15/2032; G03G 15/206; G03G 15/2067; G03G 15/2089; G03G 2215/2035; G03G 2215/2038
USPC ..... 399/328, 329
See application file for complete search history.

(56) References Cited

U.S. PATENT DOCUMENTS

| | | | | |
|---|---|---|---|---|
| 2004/0042809 | A1* | 3/2004 | Fuma et al. | 399/67 |
| 2007/0183798 | A1* | 8/2007 | Moriguchi et al. | 399/33 |
| 2010/0247184 | A1 | 9/2010 | Iwai | |
| 2011/0085832 | A1* | 4/2011 | Hasegawa et al. | 399/329 |

* cited by examiner

*Primary Examiner* — Benmjamin Schmitt
(74) *Attorney, Agent, or Firm* — Patteson & Sheridan LLP

(57) ABSTRACT

Certain embodiments provide a fuser including a cylindrical fixing belt, a heating unit configured to heat the fixing belt, a pressurized section, a first nip forming section, a second nip forming section, and a moving mechanism. The pressurized section is arranged in contact with the fixing belt. The first nip forming section is fixed in a position where the first nip forming section presses the fixing belt against the pressurized section. The second nip forming section is configured to be movable between a position where the second nip forming section can press the fixing belt against the pressurized section and a position where the second nip forming section is separated from the fixing belt. The moving mechanism moves the second nip forming section.

15 Claims, 13 Drawing Sheets

(a)

(b)

(a)

(b)

(a)

(b)

(a)

(b)

(a)

(b)

(a)

(b)

FUSER, IMAGE FORMING APPARATUS, AND IMAGE FORMING METHOD

CROSS-REFERENCE TO RELATED APPLICATION

This application is based upon and claims the benefit of priority from Provisional U.S. Applications 61/502,304 filed on Jun. 28, 2011 and 61/502,309 filed on Jun. 28, 2011 the entire contents of which are incorporated herein by reference.

TECHNICAL FIELD

Embodiments described herein relate generally to a fuser, an image forming apparatus and an image forming method.

BACKGROUND

A fuser included in an image forming apparatus includes a cylindrical fixing belt, a pressurized section arranged in contact with the fixing belt and including, for example, a pressurizing roller, and a nip forming section configured to press the fixing belt against the pressurized section and including, for example, a pressurizing pad. In the fuser, the nip forming section presses the fixing belt against the pressurized section to thereby form a nip portion between the nip forming section and the pressurized section. Thereafter, the fuser heats the fixing belt to desired temperature. After the temperature of the fixing belt reaches the desired temperature, when a sheet having a toner image formed thereon is conveyed to the nip portion, the nip portion fuses and presses the toner image and fixes the toner image on the sheet.

In the fuser, further improvement of fixing performance is desired. In order to improve the fixing performance, it is necessary to extend the nip portion in appearance to increase nip width. However, if the nip portion is extended, since an area of contact of the nip forming section with the fixing belt expands, the heat capacity of the fixing belt increases. Therefore, a long time is necessary from power-on of the image forming apparatus until the temperature of the fixing belt reaches the desired temperature.

DETAILED DESCRIPTION

Certain embodiments provide a fuser including a cylindrical fixing belt, a heating unit configured to heat the fixing belt, a pressurized section, a first nip forming section, a second nip forming section, and a moving mechanism. The pressurized section is arranged in contact with the fixing belt. The first nip forming section is fixed in a position where the first nip forming section presses the fixing belt against the pressurized section. The second nip forming section is configured to be movable between a position where the second nip forming section can press the fixing belt against the pressurized section and a position where the second nip forming section is separated from the fixing belt. The moving mechanism moves the second nip forming section.

Exemplary embodiments are explained below.

First Embodiment

Figure 1:
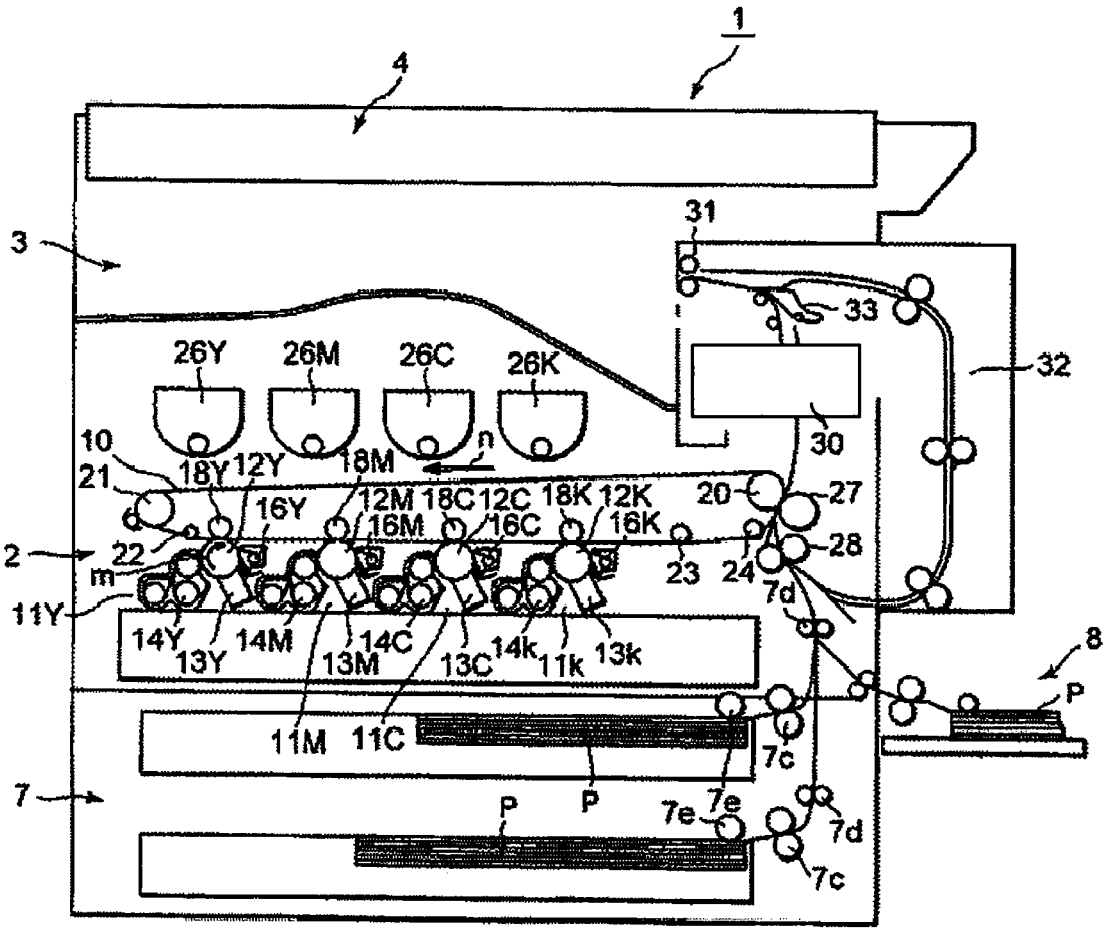
FIG. 1 is a schematic explanatory diagram of an image forming apparatus according to a first embodiment.

FIG. 1 is a schematic explanatory diagram of an image forming apparatus according to a first embodiment. An image forming apparatus 1 includes a scanner section 4 that reads a document image, a printer section 2 that forms a copy image, a paper feeding device 7 and a manual paper feeding device 8 that feed a sheet P, which is a recording medium, to the printer section 2, and a paper discharge section 3 that accumulates the sheet P discharged from the printer section 2.

The scanner section 4 reads a document image and forms electronic data based on the read document image.

The printer section 2 forms a copy image on the basis of the electronic data formed by the scanner section 4. The printer section 2 includes four sets of image forming stations 11Y, 11M, 11C, and 11K for Y (yellow), M (magenta), C (cyan), and K (black) arranged in parallel along the lower side of an intermediate transfer belt 10 explained below.

The image forming station 11Y includes a photoconductive drum 12Y as an image bearing member. The image forming station 11Y forms a Y (yellow) toner image on a photoconductive drum 12Y.

The photoconductive drum 12Y rotates in an arrow m direction. Around the photoconductive drum 12Y, an electrifying charger 13Y, a developing device 14Y, and a photoconductive member cleaner 16Y are arranged along the rotating direction. Similarly, around a photoconductive drum 12M, an electrifying charger 13M, a developing device 14M, and a photoconductive member cleaner 16M are arranged along the rotating direction. The image forming station 11M, the image forming station 11C, and the image forming station 11K have the same configuration as the image forming station 11Y. Therefore, reference numerals same as those of the components of the image forming station 11Y are used except signs representing the colors. Explanation of the image forming station 11M, the image forming station 11C, and the image forming station 11K is omitted.

The intermediate transfer belt 10 is arranged such that the outer circumferential surface thereof is in contact with the photoconductive drums 12Y, 12M, 12C, and 12K. The intermediate transfer belt 10 is stretched and suspended by a backup roller 20, a driven roller 21, and first to third tension rollers 22 to 24. The intermediate transfer belt 10 is rotated in an arrow n direction according to the rotation of the backup roller 20.

A primary transfer roller 18Y is provided in a position opposed to the photoconductive drum 12Y across the intermediate transfer belt 10. The same applies to primary transfer rollers 18M, 18C, and 18K.

A secondary transfer roller 27 is arranged in a position opposed to the backup roller 20 across the intermediate transfer belt 10.

A pickup roller 7*e*, a separating roller 7*c*, a conveying roller 7*d*, and a registration roller pair 28 are provided between the paper feeding device 7 and the secondary transfer roller 27.

A fuser 30 is provided further downstream than the secondary transfer roller 27 along a conveying direction of the sheet P. The fuser 30 fixes a toner image, which is secondarily transferred onto the sheet P, on the sheet P.

A gate 33 that diverts the sheet P in the direction of a paper discharge roller 31 or the direction of a re-conveying unit 32 is provided downstream of the fuser 30.

If the image forming apparatus 1 explained above is in a monochrome mode, the image forming apparatus 1 rotates only the photoconductive drum 12K for black in the arrow m direction to form a monochrome image. If the image forming apparatus 1 is in a color mode, the image forming apparatus 1 rotates all the photoconductive drums 12Y, 12M, 12C, and 12K to form a color image.

Figure 2:
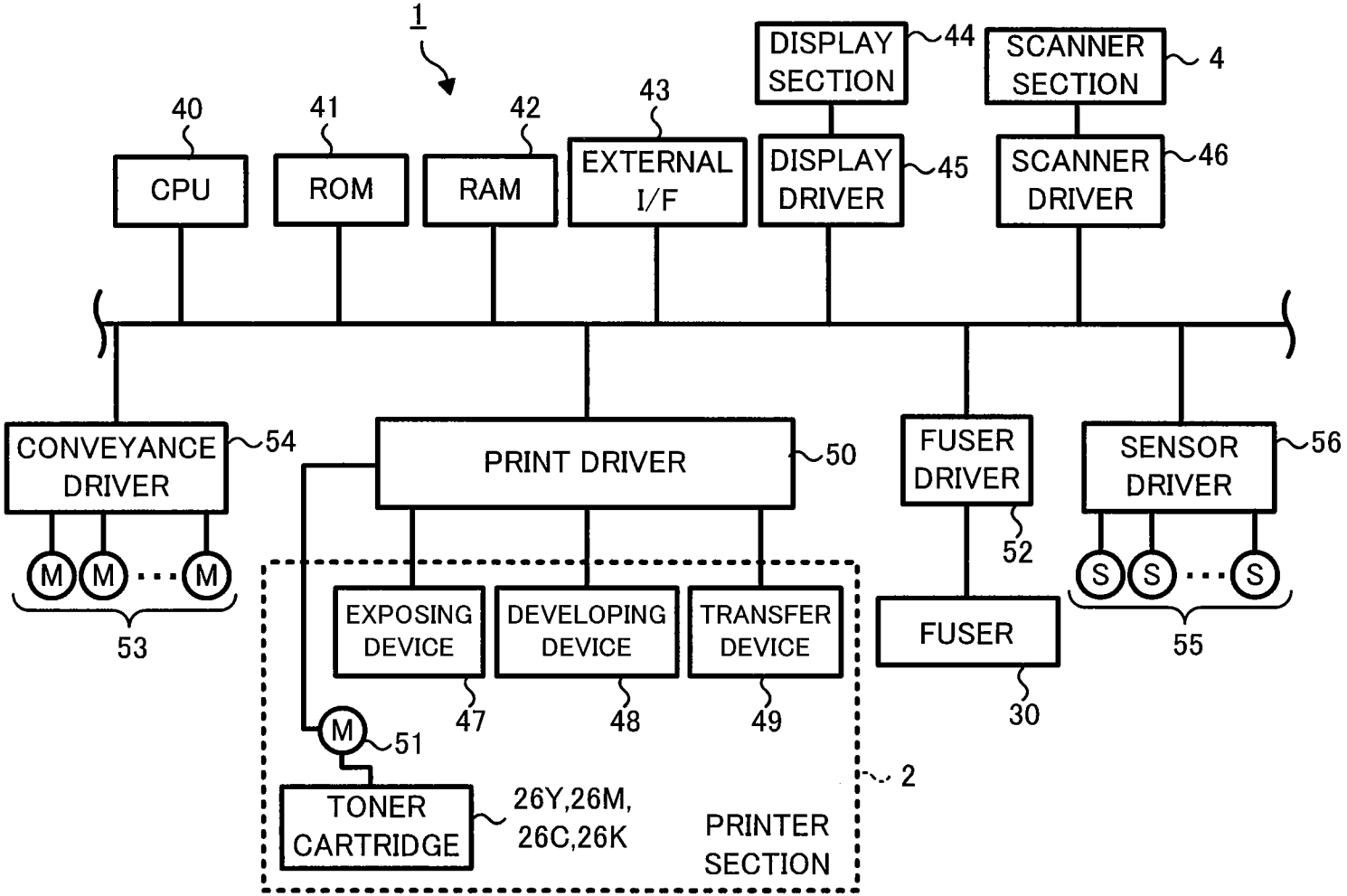
FIG. 2 is a schematic block diagram of an electrical connection relation of the image forming apparatus.

FIG. 2 is a schematic block diagram of an electrical connection relation of the image forming apparatus according to the first embodiment. As shown in FIG. 2, the image forming apparatus 1 includes a CPU 40, which is a controller that manages overall control, a ROM 41 having stored therein control programs and the like, a RAM 42 that temporarily stores data, and an external interface 43 for exchanging various data between various devices, which can communicate with the image forming apparatus 1, and the image forming apparatus 1. The ROM 41, the RAM 42, and the external interface 43 are connected to the CPU 40.

The image forming apparatus 1 includes a display section 44 for inputting various kinds of information to the image forming apparatus 1 or displaying a state of the image forming apparatus 1. The display section 44 is connected to the CPU 40 via a display driver 45 for driving the display section 44.

As explained above, the image forming apparatus 1 includes the scanner section 4, the printer section 2, and the fuser 30. The scanner section 4 is connected to the CPU 40 via a scanner driver 46 for driving the scanner section 4.

The printer section 2 includes an exposing device 47, a developing device 48, and a transfer device 49. The exposing device 47, the developing device 48, the transfer device 49, and a motor 51 for rotating toner cartridges 26Y, 26M, 26C, and 26K are connected to the CPU 40 via a printer driver 50 for driving the exposing device 47, the developing device 48, the transfer device 49, and the motor 51.

The fuser 30 is connected to the CPU 40 via a fuser driver 52 for driving the fuser 30.

The image forming apparatus 1 includes a conveyance driver 54 for rotating conveying motors 53. The conveyance driver 54 is connected to the CPU 40. The conveyance driver 54 rotates the conveying motors 53 for rotating, for example, the various rollers and the gate 33 shown in FIG. 1.

The image forming apparatus 1 includes a sensor driver 56 for driving various sensors 55. The sensor driver 56 is connected to the CPU 40.

Figure 3:
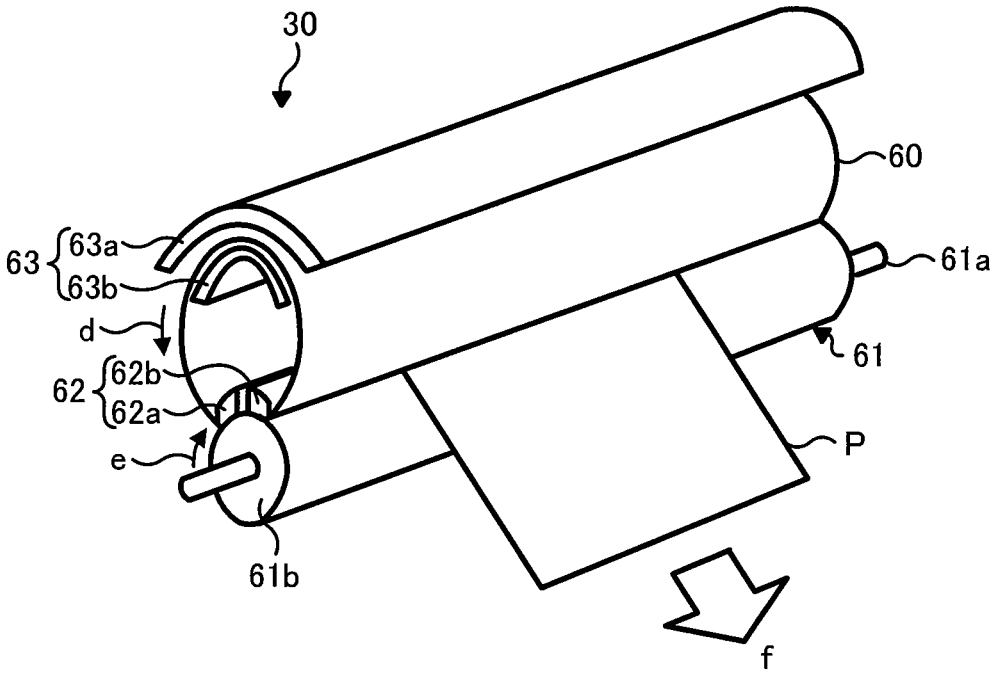
FIG. 3 is a perspective view of a main part of a fuser provided in the image forming apparatus.

The fuser provided in the image forming apparatus is explained in detail. FIG. 3 is a perspective view of a main part of the fuser 30 included in the image forming apparatus according to the first embodiment. As shown in FIG. 3, the fuser 30 includes a fixing belt 60, a pressurized section 61, a nip forming section 62, and a heating unit 63.

The fixing belt 60 is a cylindrical endless belt and has multilayer structure including a heat generating layer, which is a conductive layer. The fixing belt 60 has a configuration in which, for example, the heat generating layer, an elastic layer, and a release layer are laminated in this order from the inner circumferential side to the outer circumferential side. The fixing belt 60 rotates in an arrow d direction following the pressurized section 61.

If the heating unit 63 includes an IH section 63*a*, the heat generating layer is a layer in which an eddy-current is generated by a magnetic flux generated from the IH section 63*a*. The heat generating layer is heated by Joule heat of the eddy-current generated in the heat generating layer. Metal forming the heat generating layer is, for example, Ni, Fe, Cu, Au, Ag, or Al. These kinds of metal may be independently used or an alloy of two or more kinds among these kinds of metal may be used. The heat generating layer is formed by, for example, three layers of Ni—Cu—Ni.

The elastic layer is formed of an elastic member such as silicone rubber. The release layer is formed of, for example, fluorine resin. The release layer is a layer for suppressing a toner for forming a toner image on the sheet P from adhering to the fixing belt 60.

The fixing belt 60 is reduced in thickness and reduced in heat capacity in order to reduce time necessary for warm-up. In other words, the respective thicknesses of the heat generating layer, the elastic layer, and the release layer are reduced in order to reduce the time necessary for warm-up.

The pressurized section 61 is a pressurizing roller 61 including an elastic layer 61*b* formed of heat resistant silicon sponge, silicon rubber, or the like around, for example, a cored bar 61*a* and including a release layer (not shown in the figure) formed of fluorine resin such as PFA resin on the surface of the elastic layer 61*b*. The pressurizing roller 61 is arranged in a position in contact with a part of the outer circumference of the fixing belt such that the longitudinal direction of the pressurizing roller 61 is parallel to the longitudinal direction of the fixing belt 60. A gear (not shown in the figure) provided at an end of the cored bar 61*a* is rotated by a motor (not shown in the figure), whereby the pressurizing roller 61 rotates in an arrow e direction and discharges the sheet P in an arrow f direction.

The nip forming section 62 presses the fixing belt against the pressurizing roller 61, which is the pressurized section 61, to thereby form a nip portion between the nip forming section 62 and the pressurizing roller 61. The nip forming section 62 has length necessary for satisfying desired fixing performance. The nip forming section 62 is divided into, for example, two.

A first nip forming section 62*a*, which is one of the divided nip forming sections 62, and a second nip forming section 62*b*, which is the other of the divided nip forming sections 62, are respectively pressurizing pads including release layers formed of, for example, fluorine resin, on the surfaces of elastic bodies of, for example, heat resistant silicon sponge or silicon rubber.

A first pressurizing pad 62*a*, which is the first nip forming section 62*a*, and a second pressurizing pad 62*b*, which is the second nip forming section 62*b*, are provided on the inside of the fixing belt 60. The first and second pressurizing pads 62*a* and 62*b* press the fixing belt 60 against the pressurizing roller 61 from the inside of the fixing belt 60 to thereby form a nip portion, which has nip width of length necessary for satisfying desired fixing performance, between the pressurizing roller 61 and the first and second pressurizing pads 62*a* and 62*b*.

The heating unit 63 includes the electromagnetic induction heating (IH) section 63*a* and a temperature sensitive magnetic body 63*b* and heats the fixing belt 60. The IH section 63*a* generates an eddy-current, which is an induction current, in the heat generating layer of the fixing belt 60. The IH section 63*a* includes an electromagnetic induction heating (IH) heating coil (not shown in the FIG. 63*a*-1 (FIG. 8 referred to below) and a ferrite core (not shown in the figure). The IH heating coil 63*a*-1 is, for example, a Litz wire obtained by binding plural copper wire rods coated with heat resistant polyamideimde, which is an insulating material.

The temperature sensitive magnetic body 63*b* supports raising of the temperature of the fixing belt 60. Specifically, the temperature sensitive magnetic body 63*b* indirectly raises the temperature of the fixing belt 60 on the basis of a magnetic flux generated from the IH section 63*a*. The temperature sensitive magnetic body 63*b* is formed in an arcuate shape along the inner circumferential surface of the fixing belt 60. The temperature sensitive magnetic body 63*b* is provided to be separated from the fixing belt 60 in a position opposed to the IH section 63*a* via the fixing belt 60.

The temperature sensitive magnetic body 63*b* functions as a belt guide as well besides supporting the raising of the temperature of the fixing belt 60.

Figure 4:
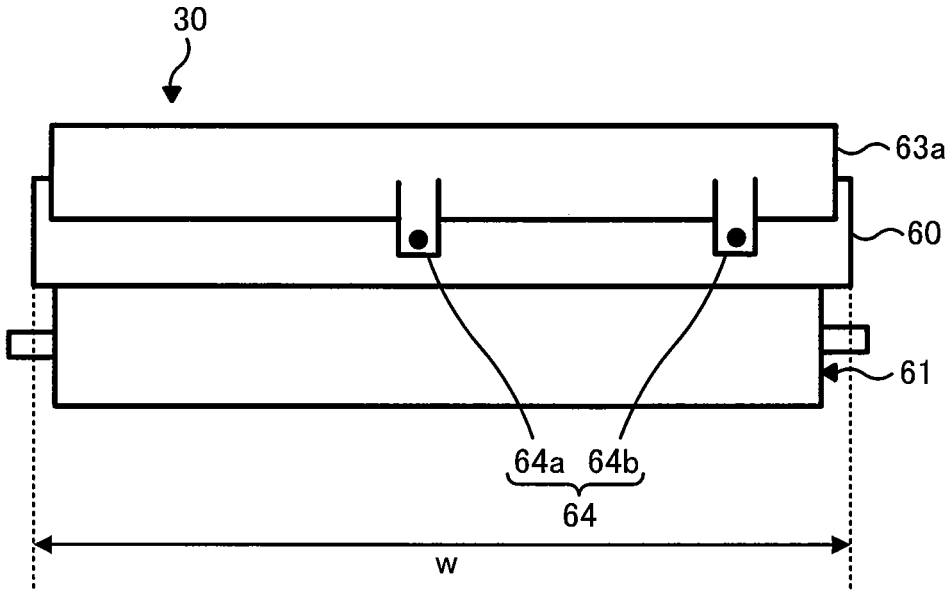
FIG. 4 is a side view of the fuser shown in FIG. 3.

FIG. 4 is a side view of the fuser 30 shown in FIG. 3. As shown in FIG. 4, the fuser 30 includes temperature sensors 64. The temperature sensors 64 are respectively thermistors of a contact type provided in contact with the center in the longitudinal direction and an end in the longitudinal direction of the fixing belt 60. A temperature sensor 64*a* provided in the center in the longitudinal direction of the fixing belt 60 (hereinafter referred to as center temperature sensor 64*a*) detects the temperature of the center in the longitudinal direction of the fixing belt 60. A temperature sensor 64*b* provided at the end in the longitudinal direction of the fixing belt 60 (hereinafter referred to as end temperature sensor 64*b*) detects the temperature of the end in the longitudinal direction of the fixing belt 60.

Figure 5:
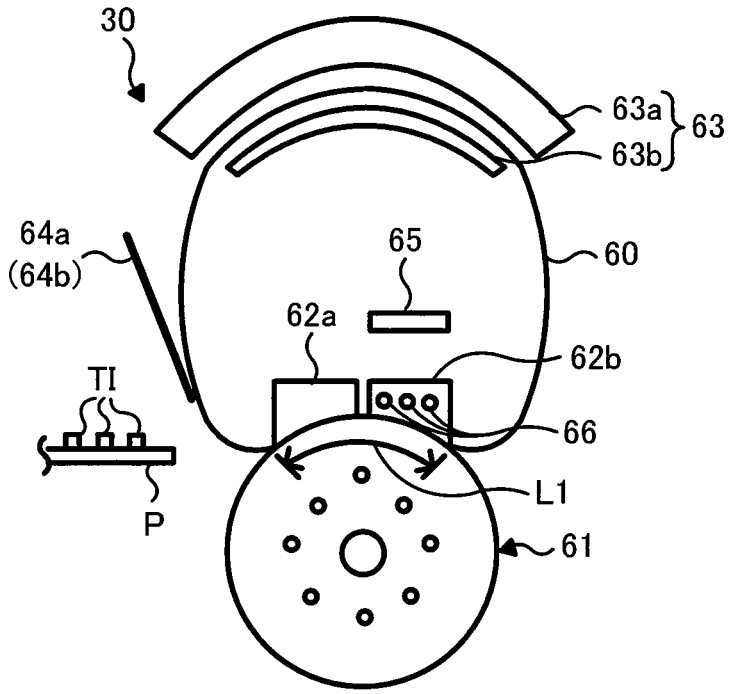
FIGS. 5A and 5B are sectional views of the fuser shown in FIGS. 3 and 4.
Figure 5:
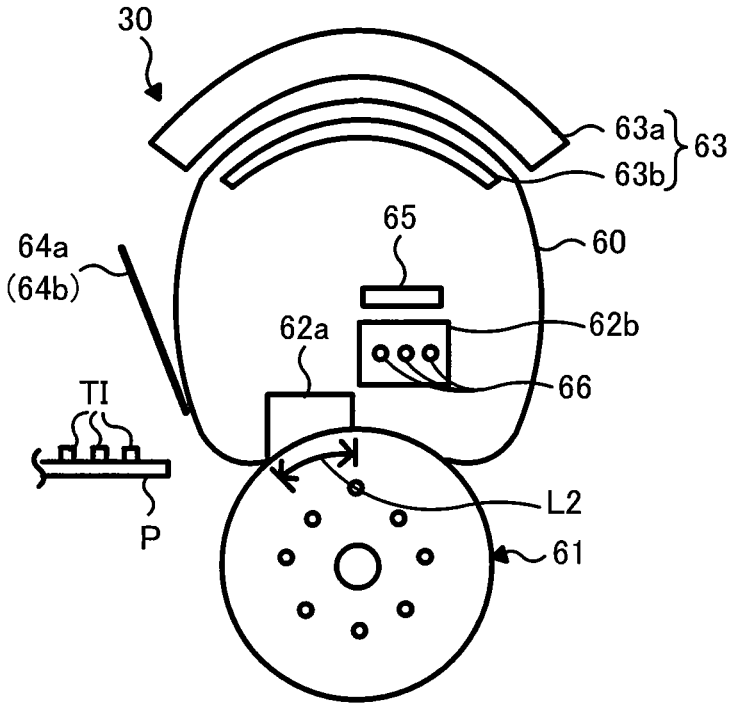

FIGS. 5A and 5B are sectional views of the fuser 30 shown in FIGS. 3 and 4. As shown in FIGS. 5A and 5B, the first pressurizing pad 62*a*, which is the first nip forming section 62*a*, is fixed in a position where the first pressurizing pad 62*a* can press the fixing belt 60 against the pressurizing roller 61, which is the pressurized section 61, from the inside of the fixing belt 60.

On the other hand, as shown in FIGS. 5A and 5B, the second pressurizing pad 62*b*, which is the second nip forming section 62*b*, is provided to be movable between a position where the second pressurizing pad 62*b* can press the fixing belt 60 against the pressurizing roller 61, which is the pressurized section 61, from the inside of the fixing belt 60 (FIG. 5A) and a position where the second pressurizing pad 62*b* is separated from the fixing belt 60 (FIG. 5B).

The fuser 30 includes a position detection sensor 65 for detecting the position of the second pressurizing pad 62*b*, which is the second nip forming section 62*b*.

As shown in FIG. 5A, if the second pressurizing pad 62*b* is arranged in the position where the second pressurizing pad 62*b* can press the fixing belt 60 against the pressurizing roller 61, the surfaces of the first and second pressurizing pads 62*a* and 62*b* and the fixing belt bend to correspond to the surface shape of the pressurizing roller 61. A nip portion having nip width L1 is formed between the first and second pressurizing pads 62*a* and 62*b* and the pressurizing roller 61. The nip width L1 is length enough for satisfying predetermined fixing performance.

As shown in FIG. 5B, if the second pressurizing pad 62*b* is arranged in the position where the second pressurizing pad 62*b* is separated from the fixing belt 60, a nip portion may not be able to be formed by the second pressurizing pad 62*b* and the pressurizing roller 61. A nip portion having nip width L2 is formed between the first pressurizing pad 62*a* and the pressurizing roller 61. The nip width L2 is smaller than the nip width L1 shown in FIG. 5A.

In other words, the fuser 30 can change the nip width of the nip portion by moving the second pressurizing pad 62*b*.

On the inside of the second pressurizing pad 62*b*, plural heat pipes 66 are provided in parallel to the longitudinal direction of the pad 62*b*. The heat pipes 66 are formed of a material having high thermal conductivity such as aluminum. If the heat distribution of the fixing belt 60 is non-uniform, the heat distribution of the fixing belt 60 can be uniformalized by arranging the second pressurizing pad 62*b* such that the second pressurizing pad 62*b* is in contact with the fixing belt 60 (FIG. 5A).

For example, it is considered that the sheet P narrower than the width w of the fixing belt 60 (FIG. 4) passes the center portion of the fixing belt 60. Every time the sheet P passes the nip portion, the sheet P deprives the heat of the center portion of the fixing belt 60. Therefore, the temperature of the center portion of the fixing belt 60 drops. Then, the heating unit 63 heats the entire fixing belt 60 in order to raise the dropped temperature to desired temperature (fixing temperature). However, even if the sheet P passes, the temperature of the end of the fixing belt 60 where the sheet P does not pass does not drop. Therefore, the temperature of the end of the fixing belt 60 rises more than necessary according to the heating of the fixing belt 60. As a result, the temperature is non-uniform between the center portion and the end of the fixing belt 60. At this point, the heat pipes 66 (FIGS. 5A and 5B) move heat from the end of the fixing belt 60, where the temperature is high, to the center portion of the fixing belt 60, where the temperature is low. Therefore, if the heat of the fixing belt 60 is non-uniform, the heat pipes 60 can uniformalize the heat of the fixing belt 60.

Figure 6:
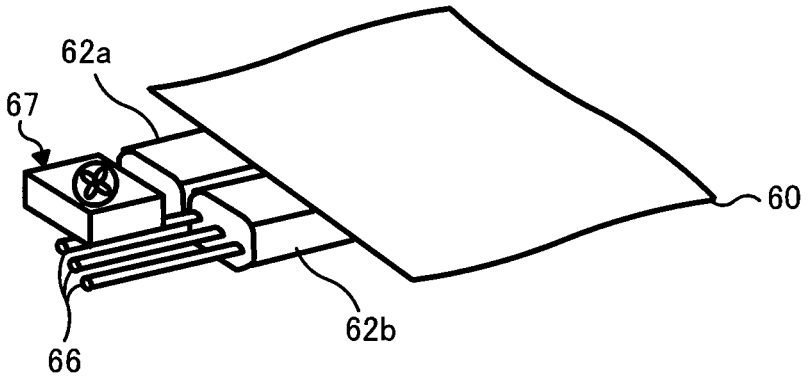
FIG. 6 is a schematic perspective view of ends of first and second pressurizing pads.

FIG. 6 is a schematic perspective view of ends of the first and second pressurizing pads 62*a* and 62*b*. As shown in FIG. 6, the heat pipes 66 are provided to pierce through the second pressurizing pad 62*b* such that both ends of the heat pipes 66 are exposed from an end face of the second pressurizing pad 62*b*.

A cooling fan 67, which is a cooler for dropping the temperature of the heat pipes 66, is provided on the heat pipes 66 exposed from the end face of the second pressurizing pad 62*b*. Since the cooling fan 67 can drop the temperature of the heat pipes 66, if the temperature of the fixing belt 60 rises too high, the cooling fan 67 can quickly cool the fixing belt 60 via the heat pipes 66 and the second pressurizing pad 62*b*.

The heat pipes 66 may be provided in the first pressurizing pad 62*a*. However, the heat pipes 66 may be not provided in the first and second pressurizing pads 62*a* and 62*b*.

Figure 7:
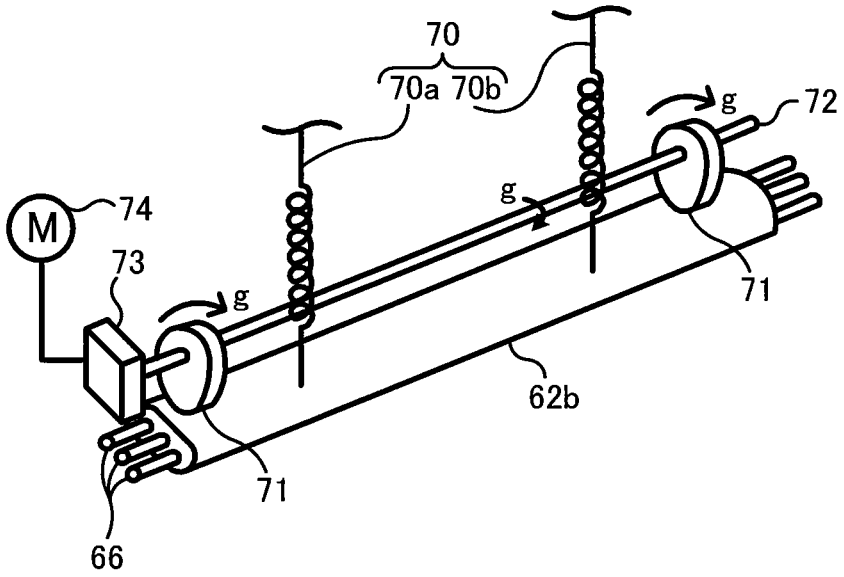
FIGS. 7A and 7B are diagrams of a moving mechanism that moves a second nip forming section.
Figure 7:
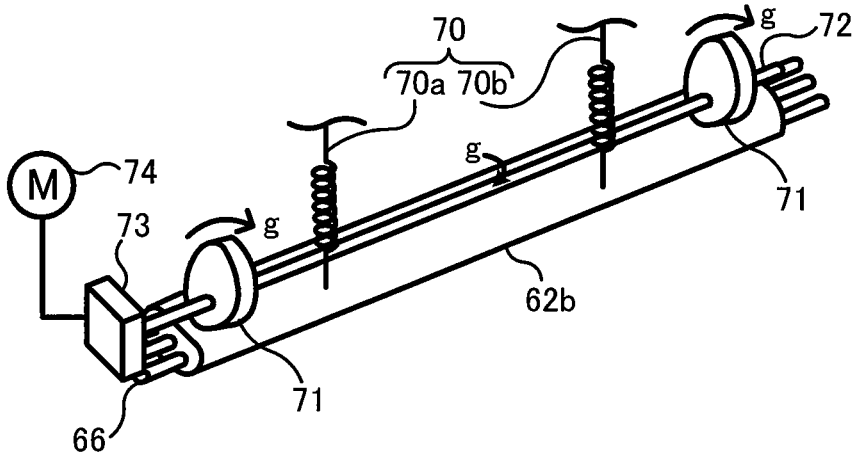

FIGS. 7A and 7B are diagrams of a moving mechanism for the nip forming section that moves the second pressurizing pad 62*b*, which is the second nip forming section 62*b*. As shown in FIGS. 7A and 7B, the nip forming section moving mechanism includes an elastic body 70 that supports the second pressurizing pad 62*b*, plural cams 71, and a cam supporting body 72 that pierces through the cams 71.

The elastic body 70 includes, for example, plural springs 70*a* and 70*b*. One ends of the respective springs 70*a* and 70*b* are fixed to the surface of the second pressurizing pad 62*b*. The other ends of the respective springs 70*a* and 70*b* are fixed in predetermined positions in the fuser 30. The second pressurizing pad 62*b* is supported by the springs 70*a* and 70*b* in a state in which the second pressurizing pad 62*b* is suspended by the springs 70*a* and 70*b*.

The plural cams 71 are formed in an elliptical shape and are fixed to the cam supporting body 72. The cams 71 can rotate according to the rotation of the cam supporting body 72.

The cam supporting body 72 is arranged above the second pressurizing pad 62*b* and in parallel to the longitudinal direction of the pad 62*b*. The cam supporting body 72 pierces through the cams 71 in positions decentered from the centers of the elliptical cams 71.

A gear section 73 for rotating the cam supporting body 72 is provided at an end of the cam supporting body 72. A nip forming section moving motor 74 is connected to the gear section 73. When the gear section 73 is driven by the motor 74, the cam supporting body 72 rotates in an arrow g direction in the figure. The cams 71 also rotate in the arrow g direction.

If the second pressurizing pad 62*b* presses the fixing belt 60 against the pressurizing roller 61, which is the pressurized section 61 (FIG. 5A), as shown in FIG. 7A, the cams 71 come into contact with the surface of the second pressurizing pad 62*b* and press the second pressurizing pad 62*b* downward (in a direction in which the pressurizing roller 61 is arranged). In other words, the second pressurizing pad 62*b* presses the pressurizing roller 61 with the cams 71.

If the second pressurizing pad 62*b* is separated from the fixing belt 60 (FIG. 5B), the cams 71 rotate from the state shown in FIG. 7A to the state shown in FIG. 7B. At this point, the second pressurizing pad 62*b* moves upward (a direction opposite to the direction in which the pressurizing roller 61 is arranged) with the elastic force of the springs 70*a* and 70*b* and separates from the fixing belt 60.

When the second pressurizing pad 62*b* moves, with the elastic force of the springs 70*a* and 70*b*, in the direction opposite to the direction in which the pressurizing roller 61 is arranged, the cams 71 may be in contact with the second pressurizing pad 64*b* as shown in FIG. 7B or may be separated from the second pressurizing pad 62*b*, although not shown in the figure.

In the fuser 30, from power-on of the image forming apparatus 1 until the temperature of the fixing belt 60 reaches predetermined temperature (e.g., fixing temperature), as shown in FIG. 5B, the second pressurizing pad 62*b* is arranged in a position where the second pressurizing pad 62*b* is separated from the fixing belt 60. When the temperature of the fixing belt 60 reaches the predetermined temperature, as shown in FIG. 5A, the second pressurizing pad 62*b* moves to the position where the second pressurizing pad 62*b* presses the fixing belt 60 against the pressurizing roller 61. The sheet P having a toner image TI formed thereon is conveyed to the fuser 30 in this state. When the sheet Preaches a nip portion between the fixing belt 60 and the pressurizing roller 61, the sheet P is conveyed to downstream of the fixing belt 60 while the toner image TI is heated and pressed. The toner image TI is fixed on the sheet P. The sheet P having the toner image TI fixed thereon is discharged from the fuser 30.

Figure 8:
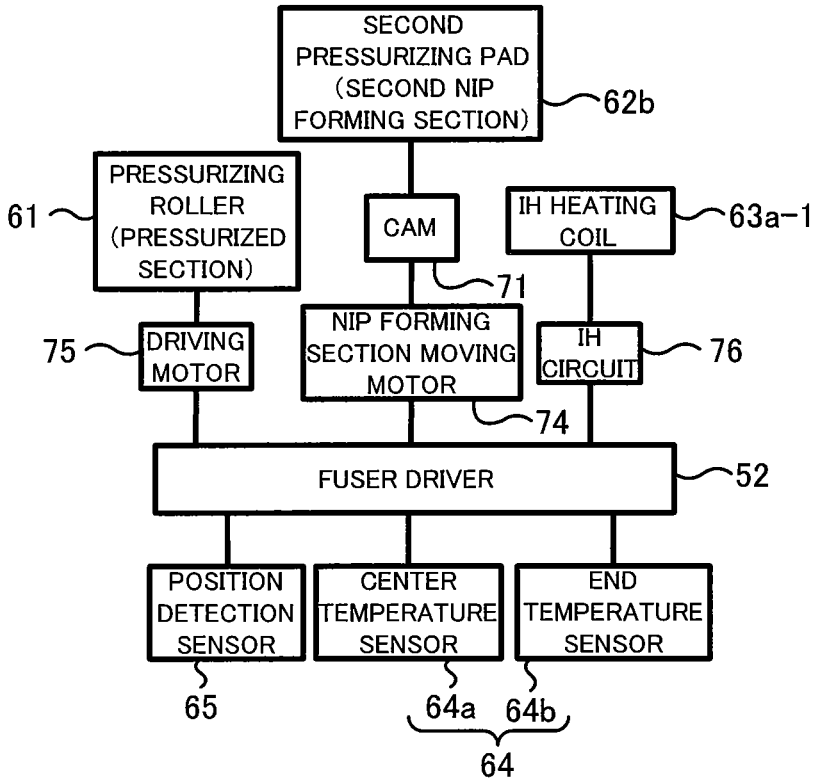
FIG. 8 is a schematic block diagram of an electrical connection relation of the fuser.

FIG. 8 is a schematic block diagram of an electrical connection relation of the fuser 30 explained above. As shown in FIG. 8, the fuser 30 includes the fuser driver 52. The temperature sensors 64 (the center temperature sensor 64*a* and the end temperature sensor 64*b*) for detecting the temperatures of the fixing belt 60, a driving motor 75 for rotating the pressurizing rolkibvou ler 61, a nip forming section moving motor 74 for rotating the cams 71, which are means for moving the second pressurizing pad 62*b*, and an IH circuit 76 for feeding a desired electric current to the IH heating coil 63*a*-1 of the IH section 63*a* are connected to the fuser driver 52.

The center temperature sensor 64*a* and the end temperature sensor 64*b* respectively detect the temperatures of the fixing belt 60 via the fuser driver 52. The driving motor 75 and the nip forming section moving motor 74 are driven by the fuser driver 52. The IH circuit 76 feeds an electric current to the IH heating coil 63*a*-1 via the fuser driver 52.

Figure 9:
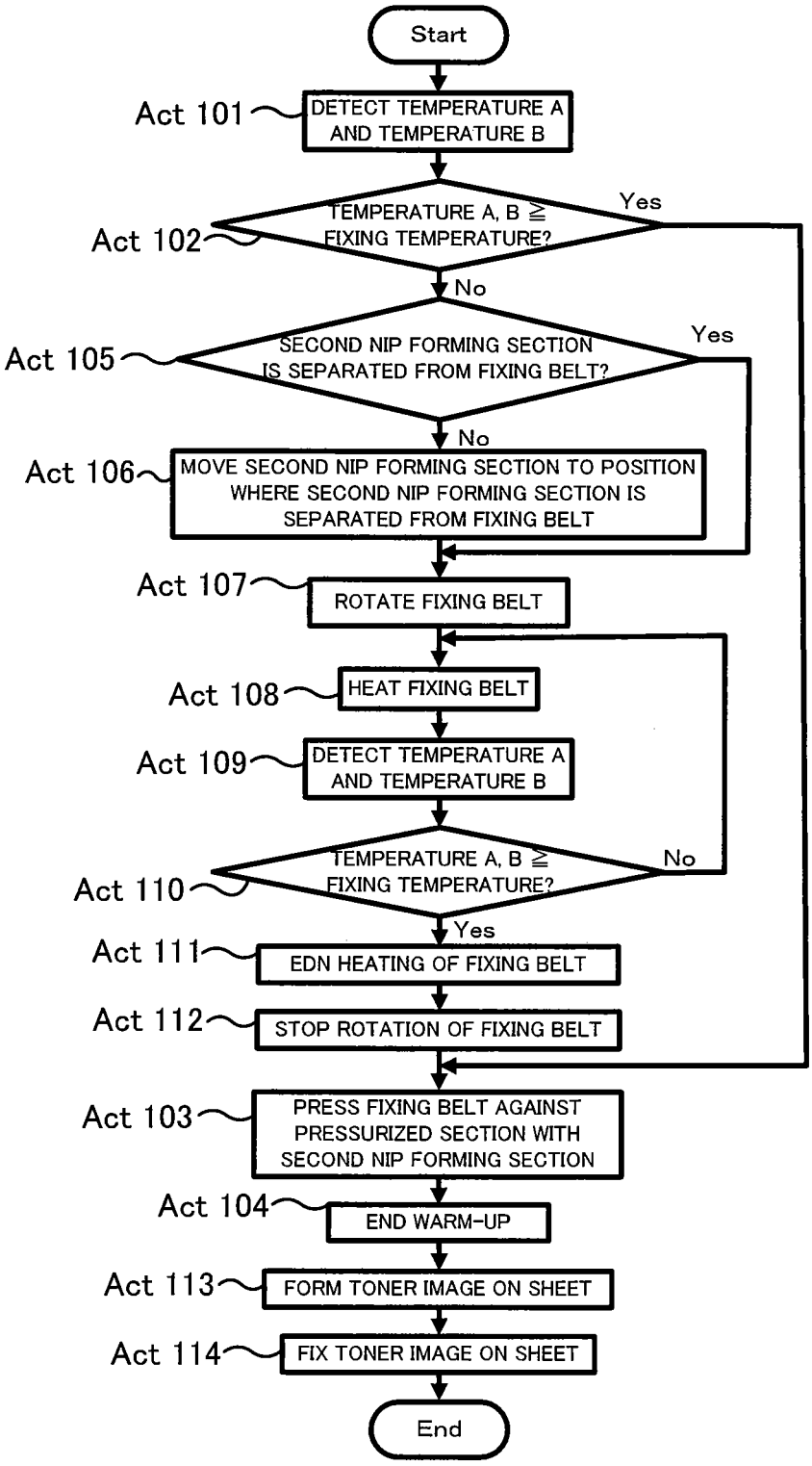
FIG. 9 is a flowchart for explaining an image forming method by the image forming apparatus.

An image forming method by the image forming apparatus 1 including the fuser 30 according to this embodiment is explained with reference to FIG. 9. FIG. 9 is a flowchart for explaining the image forming method.

When the image forming apparatus 1 is turned on, the fuser 30 performs an operation (a warm-up operation) for raising the temperature of the fixing belt 60 to predetermined temperature (e.g., fixing temperature (160° C.). The warm-up operation is as explained below.

When the image forming apparatus 1 is turned on, the CPU 40 drives the fuser driver 52 to detect the temperature of the center of the fixing belt 60 (the temperature is hereinafter referred to as temperature A) and the temperature of the end of the fixing belt 60 (the temperature is hereinafter referred to as temperature B) using the center temperature sensor 64*a* and the end temperature sensor 64*b* (Act 101).

Subsequently, the CPU 40 determines whether both the temperature A and the temperature B are equal to or higher than the fixing temperature (Act 102). The CPU 40 performs this determination by, for example, comparing the detected temperature A and temperature B and fixing temperature information stored in the ROM 41 in advance.

If the CPU 40 determines that both the temperature A and the temperature B are equal to or higher than the fixing temperature (Yes in Act 102), the CPU 40 drives the fuser driver 52 to rotate the nip forming section moving motor 74 and move the second pressurizing pad 62*b* such that the second pressurizing pad 62*b*, which is the second nip forming section 62*b*, presses the fixing belt 60 against the pressurizing roller 61 (Act 103). The CPU 40 ends the warm-up operation (Act 104).

On the other hand, if the CPU 40 determines in Act 102 that at least one of the temperature A and the temperature B is lower than the fixing temperature (No in Act 102), the CPU 40 drives the fuser driver 52 to detect the position of the second pressurizing pad 62*b* using the position detection sensor 65 and determines whether the second pressurizing pad 62*b* is separated from the fixing belt 60 (Act 105).

If the CPU 40 determines that the second pressurizing pad presses the fixing belt 60 against the pressurizing roller 61 (No in Act 105), the CPU 40 drives the fuser driver 52 to rotate the nip forming section moving motor 74 and separate the second pressurizing pad 62*b* from the fixing belt 60 (Act 106).

If the CPU 40 separates the second pressurizing pad 62*b* from the fixing belt 60 in Act 106 or if the CPU 40 determines in Act 105 that the second pressurizing pad 62*b* is separated from the fixing belt 60 (Yes in Act 105), the CPU 40 rotates the fixing belt 60 (Act 107).

The rotation of the fixing belt 60 is performed as explained below. The CPU 40 drives the fuser driver 52 to rotate the driving motor 75 and rotate the pressurizing roller 61. The fixing belt 60 also rotates according to the rotation of the pressurizing roller 61.

Thereafter, the image forming apparatus 1 heats the fixing belt 60 (Act 108). Specifically, the image forming apparatus 1 heats the fixing belt 60 in a state in which the second pressurizing pad 62*b* is separated from the fixing belt 60.

The heating of the fixing belt 60 is performed as explained below. The CPU 40 drives the fuser driver 52 to energize the IH circuit 76, feed an electric current to the IH heating coil 63*a*-1, and heat the fixing belt 60.

Subsequently, the CPU 40 detects the temperatures (the temperature A and the temperature B) of the fixing belt 60 (Act 109) and determines whether both the temperature A and the temperature B are equal to or higher than the fixing temperature (Act 110).

If the CPU 40 determines that at least one of the temperature A and the temperature B is lower than the fixing temperature (No in Act 110), the CPU 40 repeats Act 108 and Act 109 until the CPU 40 determines in Act 110 that both the temperature A and the temperature B are equal to or higher than the fixing temperature (Yes in Act 110).

If the CPU 40 determines that both the temperature A and the temperature B are equal to or higher than the fixing temperature (Yes in Act 110), the CPU 40 causes the fuser driver 52 to stop the energization to the IH circuit 76 and ends the heating of the fixing belt 60 (Act 111).

When the heating of the fixing belt 60 ends, the CPU 40 stops the rotation of the fixing belt 60 (Act 112). The stop of the rotation of the fixing belt 60 is performed as explained below. The CPU 40 causes the fuser driver 52 to stop the rotation of the driving motor 75 and stop the rotation of the pressurizing roller 61. The pressurizing roller 61 stops, whereby the rotation of the fixing belt 60 also stops.

Thereafter, as explained above, the CPU 40 drives the fuser driver 52 to rotate the nip forming section moving motor 74 to move the second pressurizing pad 62*b* such that the second pressurizing pad 62*b* presses the fixing belt 60 against the pressurizing roller 61 (Act 103). The CPU 40 completes the warm-up operation (Act 104).

Thereafter, the image forming apparatus 1 forms the toner image TI on the sheet P (Act 113) and causes the fuser 30 to fix the toner image TI on the sheet P (Act 114). Specifically, the CPU 40 causes the conveyance driver 54 to drive the conveying motors 53 to rotate the various rollers, pick up a sheet from paper feeding cassettes 7*a* and 7*b* or the manual paper feeding device 8, and convey the sheet to the printer section 2. Subsequently, the CPU 40 drives the printer driver 50 to form the toner image TI on the sheet P (Act 113).

The CPU 40 causes the conveyance driver 54 to drive the conveying motors 53 to rotate the various rollers and convey the sheet P having the toner image TI formed thereon to the fuser 30. Subsequently, the CPU 40 drives the fuser driver 52 to fix the toner image TI on the sheet P (Act 113).

In this way, the image forming apparatus 1 forms a copy image on the sheet P. The sheet P having the copy image formed thereon is discharged to the paper discharge section 3 or conveyed to the re-conveying unit 32.

Specifically, the CPU 40 causes the conveyance driver 54 to rotate the paper discharge roller 31, divert the gate 33 to a predetermined direction, and discharge the sheet P having the toner image TI fixed thereon, i.e., the sheet P having the copy image formed thereon to the paper discharge section 3. Alternatively, the CPU 40 causes the conveyance driver 54 to divert the gate 33 to the predetermined direction and convey the sheet P having the copy image formed thereon to the re-conveying unit 32.

The sheet P conveyed to the re-conveying unit 32 is conveyed to the printer section 2 again. The printer section 2 forms the toner image TI on the sheet P. The fuser 30 fixes the toner image TI on the sheet P. Thereafter, the sheet P is discharged to the paper discharge section 3.

The image forming method explained above is executed by the CPU 40 according to a computer program stored in the ROM 41 (FIG. 2).

In the fuser 30, the image forming apparatus 1, and the image forming method according to this embodiment explained above, the first and second pressurizing pads 62*a* and 62*b* that can form nip width necessary for satisfying desired fixing performance are provided in the fuser 30. The first pressurizing pad 62*a* is fixed. However, the second pressurizing pad 62*b* is provided to be movable between the position where the second pressurizing pad 62*b* presses the fixing belt 60 against the pressurizing roller 61 and the position where the second pressurizing pad 62*b* is separated from the fixing belt 60. The second pressurizing pad 62*b* is separated from the fixing belt 60 from power-on of the image forming apparatus 1 until the temperature of the fixing belt 60 in the fuser 30 reaches the predetermined temperature (the warm-up ends). Therefore, it is possible to reduce a substantial heat capacity of the fixing belt 60 from power-on of the image forming apparatus 1 until the warm-up ends.

After the warm-up ends, the image forming apparatus 1 moves the second pressurizing pad 62*b* to a position where the fixing belt 60 can be pressed against the pressurizing roller 61 and forms a nip portion having nip width necessary for satisfying the desired fixing performance.

Therefore, it is possible to reduce, without deteriorating fixing performance, time from power-on of the image forming apparatus 1 until the warm-up ends.

Second Embodiment

An image forming apparatus and a fuser according to a second embodiment are explained below. The image forming apparatus according to the second embodiment is the same as the image forming apparatus according to the first embodiment except the configuration of the fuser. Therefore, the explanation of the image forming apparatus is omitted. A fuser 80 according to the second embodiment is explained below.

Figure 10:
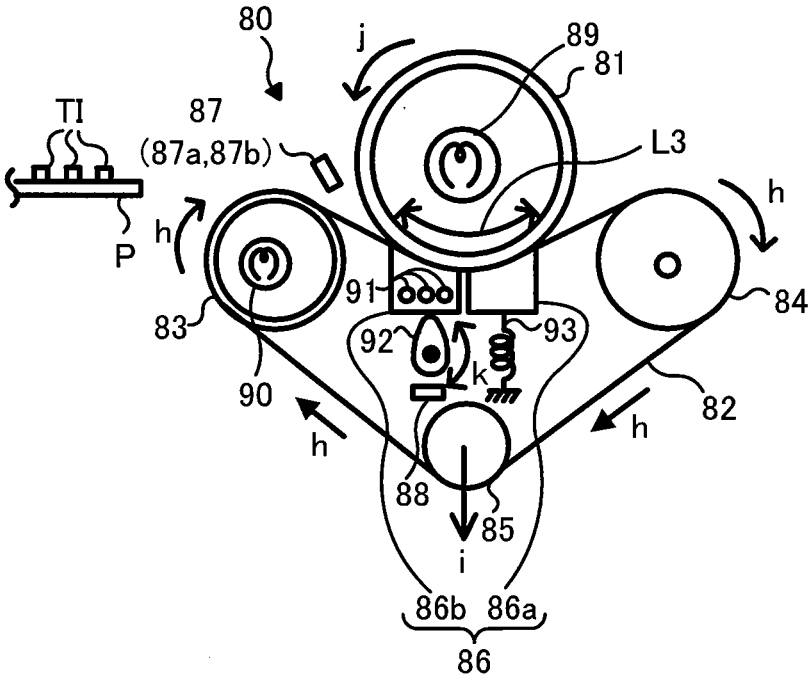
FIGS. 10A and 10B are sectional views of a fuser according to a second embodiment.
Figure 10:
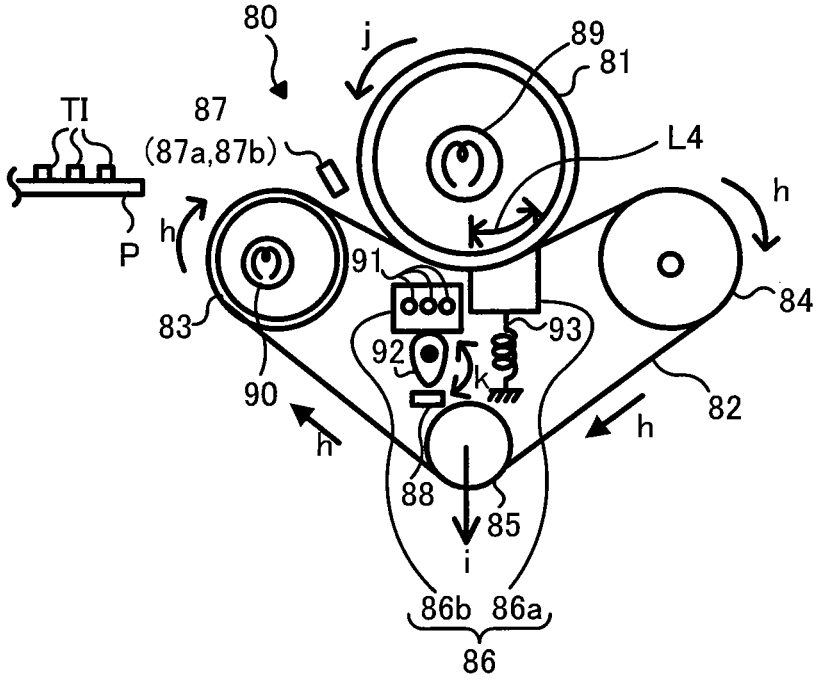
Figure 11:
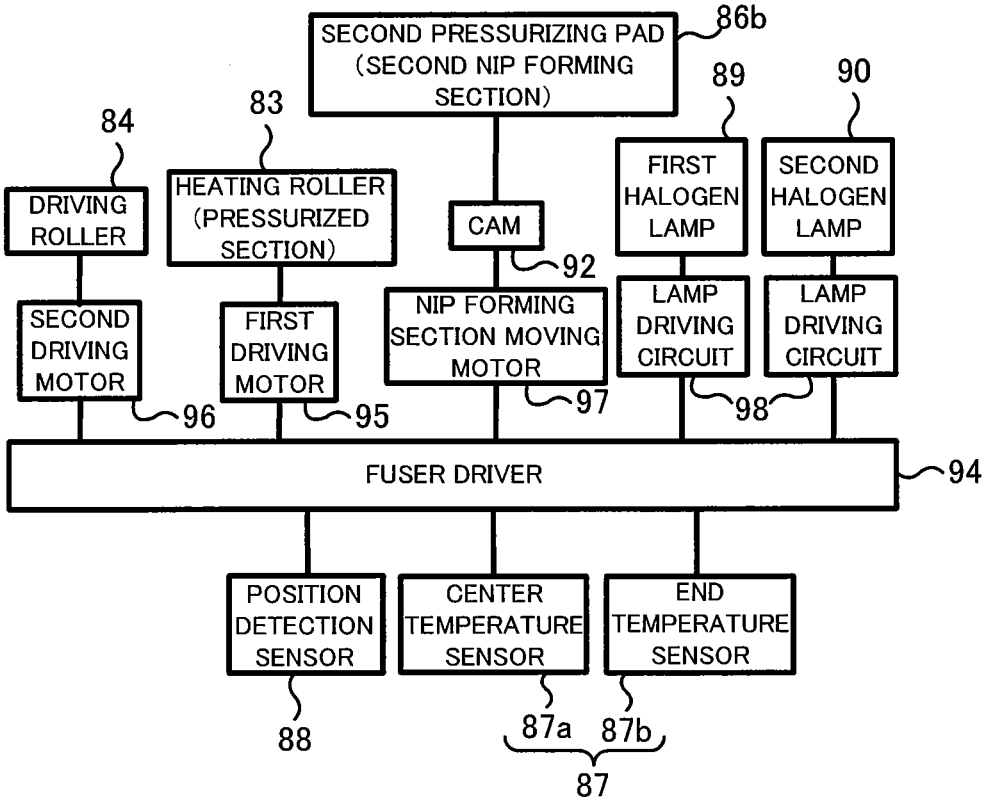
FIG. 11 is a schematic block diagram of an electrical connection relation of the fuser.

FIGS. 10A and 10B are sectional views of the fuser according to the second embodiment. As shown in FIGS. 10A and 10B, the fuser 80 according to the second embodiment includes a pressurized section 81, a fixing belt 82, a heating roller 83, a driving roller 84, a tension roller 85, a nip forming section 86, temperature sensors 87, and a position detection sensor 88.

The pressurized section 81 is a pressurizing roller 81 in which, for example, the surface of a hollow aluminum roller is covered with a release layer. The pressurized section 81 rotates in an arrow j direction. A first halogen lamp 89, which is a heating unit that heats the fixing belt 82, is provided on the inside of the hollow of the pressurizing roller 81.

The first halogen lamp 89 is provided along the longitudinal direction of the pressurizing roller 81. The first halogen lamp 89 heats the entire area in the longitudinal direction of the pressurizing roller 81 with light emission of the lamp. The heat of the pressurizing roller 81 moves to the fixing belt 82, which is in contact with the pressurizing roller 81, whereby the fixing belt 82 is heated.

The fixing belt 82 is a cylindrical endless belt and is a belt having multilayer structure in which, for example, an elastic layer and a release layer are laminated in this order from the inner circumferential side to the outer circumferential side. The fixing belt 82 is arranged such that a part of the outer circumference is in contact with the pressurizing roller 81.

The heating roller 83, the driving roller 84, and the tension roller 85 are provided on the inside of the fixing belt 82.

The heating roller 83 is made of, for example, a hollow aluminum roller. The heating roller 83 is provided, such that the longitudinal direction of the heating roller is parallel to the longitudinal direction of the pressurizing roller 81, on the inside of the fixing belt and in a position where the heating roller 83 is separated from the pressurizing roller 81. The pressurizing roller 83 rotates in an arrow h direction.

A second halogen lamp 90, which is a heating unit that heats the fixing belt 82, is provided on the inside of the hollow of the heating roller 83.

The second halogen lamp 90 is provided along the longitudinal direction of the heating roller 83. The second halogen lamp 90 heats the entire area in the longitudinal direction of the heating roller 83 with light emission of the lamp. The heat of the heating roller 83 moves to the fixing belt 82, which is in contact with the heating roller 83, whereby the fixing belt 82 is heated.

The driving roller 84 includes solid rubber around a cored bar made of, for example, stainless steel (SUS). The driving roller 84 is provided, such that the longitudinal direction of the driving roller 84 is parallel to the longitudinal direction of the pressurizing roller 81, on the inside of the fixing belt 82 and in a position where the driving roller 84 is separated from the pressurizing roller 81 and the heating roller 83. The driving roller 84 rotates in the arrow h direction.

The tension roller 85 is a roller obtained by covering a cored bar made of, for example, SUS with a PFA tube. The tension roller 85 is provided, such that the longitudinal direction of the tension roller 85 is parallel to the longitudinal direction of the pressurizing roller 81, on the inside of the fixing belt 82 and in a position where the tension roller 85 is separated from the pressurizing roller 81, the heating roller 83, and the driving roller 84.

A load is applied to the tension roller 85 in an arrow direction in the figure. The fixing belt 82 is stretched and suspended by the heating roller 83, the driving roller 84, and the tension roller 85 to which a load is applied in the arrow i direction in the figure.

The fixing belt 82 rotates in the arrow h direction following the rotation of the heating roller 83 and the driving roller 84. The pressurizing roller 81 rotates in the arrow j direction following the rotation of the fixing belt 82.

The nip forming section 86 is provided in the same manner as the nip forming section 62 provided in the fuser 30 according to the first embodiment. The nip forming section 86 presses the fixing belt 82 against the pressuring roller 81, which is the pressurized section 81, to thereby form a nip portion between the nip forming section 86 and the pressurizing roller 81. The nip forming section 86 has length necessary for satisfying desired fixing performance. For example, the nip forming section 86 is divided into two.

A first nip forming section 86*a*, which is one of the divided nip forming sections 86, is a first pressurizing pad 86*a* same as the first pressurizing pad 62*a* provided in the fuser 30 according to the first embodiment. A second nip forming section 86*b*, which is the other of the divided nip forming sections 86, is a second pressurizing pad 86*b* same as the second pressurizing pad 62*b* provided in the fuser 30 according to the first embodiment.

The first pressurizing pad 86*a* and the second pressurizing pad 86*b* are provided on the inside of the fixing belt 82. The first and second pressurizing pads 86*a* and 86*b* press the fixing belt 82 against the pressurizing roller 81 from the inside of the fixing belt 82 to thereby form a nip portion, which has nip width of length necessary for satisfying the desired fixing performance, between the pressurizing roller 81 and the first and second pressurizing pads 86*a* and 86*b*.

The first pressurizing pad 86*a* is fixed by a spring 93 in a position where the first pressurizing pad 86*a* can press the fixing belt 82 against the pressurizing roller from the inside of the fixing belt 82. The first pressurizing pad 86*a* presses the fixing belt 82 against the pressurizing roller 81 with the elastic force of the spring 93.

The second pressurizing pad 86*b* is provided to be movable between a position where the second pressurizing pad 86*b* can press the fixing belt 82 against the pressurizing roller 81 from the inside of the fixing belt 82 (FIG. 10A) and a position where the second pressurizing pad 86*b* is separated from the fixing belt 82 (FIG. 10B).

As shown in FIG. 10A, if the second pressurizing pad 86*b* is arranged in the position where the second pressurizing pad 86*b* can press the fixing belt 82 against the pressurizing roller 81, a nip portion having nip width L3 is formed between the first and second pressurizing pads 86*a* and 86*b* and the pressurizing roller 81. The nip width L3 is length enough for satisfying the desired fixing performance.

As shown in FIG. 10B, if the second pressurizing pad 86*b* is arranged in the position where the second pressurizing pad 86*b* is separated from the fixing belt 82, a nip portion may not be able to be formed by the second pressurizing pad 86*b* and the pressurizing roller 81. A nip portion having nip width L4 is formed between the first pressurizing pad 86*a* and the pressurizing roller 81. The nip width L4 is smaller than the nip width L3 shown in FIG. 10A.

The fuser 80 can change the nip width of the nip portion by moving the second pressurizing pad 86*b*.

Plural head pipes 91 are provided on the inside of the second pressurizing pad 86*b* in parallel to the longitudinal direction of the pad 86*b*. Therefore, if the heat distribution of the fixing belt 82 is non-uniform, the second pressurizing pad 86*b* is arranged in the position shown in FIG. 10A, whereby the heat distribution of the fixing belt 82 can be uniformalized.

The second pressurizing pad 86*b* can be moved as shown in FIGS. 10A and 10B according to the rotation in an arrow k direction of cams 92. The cams 92 only have to be rotated in the same manner as the cams 71 shown in FIGS. 7A and 7B.

The temperature sensors 87 include a center temperature sensor 87*a* for detecting the temperature of the center in the longitudinal direction of the fixing belt 82 and an end temperature sensor 87*b* for detecting the temperature of an end in the longitudinal direction of the fixing belt 82. The temperature sensors 87*a* and 87*b* are respectively thermistors of a non-contact type provided in positions separated from the fixing belt 82. The temperature sensors 87*a* and 87*b* are provided near an upstream portion of the fixing belt 82.

The position detection sensor 88 is a sensor for detecting the position of the second pressurizing pad 86*b*. The position detection sensor 88 is provided on the inside of the fixing belt 82.

In the fuser 80, from power-on of the image forming apparatus until the temperature of the fixing belt 82 reaches desired temperature (e.g., fixing temperature), as shown in FIG. 10B, the second pressurizing pad 86*b* is arranged in the position where the second pressurizing pad 86*b* is separated from the fixing belt 82. If the temperature of the fixing belt 82 reaches the desired temperature, as shown in FIG. 10A, the second pressurizing pad 86*b* moves to the position where the second pressurizing pad 86*b* can press the fixing belt 82 against the pressurizing roller 81. The sheet P having the toner image TI formed thereon is conveyed to the fuser 80 in this state. When the sheet P reaches a nip portion between the fixing belt 82 and the pressurizing roller 81, the sheet P is conveyed to downstream of the fixing belt 82 while the toner image TI is heated and pressed. The toner image TI is fixed on the sheet P. The sheet P having the toner image TI fixed thereon is discharged from the fuser 80.

The image forming method by the image forming apparatus including the fuser 80 explained above is basically the same as the image forming method shown in FIG. 9. Therefore, detailed explanation of the image forming method by the image forming apparatus according to the second embodiment is omitted.

However, in the image forming method shown in FIG. 9, the rotation of the fixing belt 82 (Act 107) is performed as explained below. The CPU 40 drives a fuser driver 94 to rotate first and second driving motors 95 and 96 and rotate the heating roller 83 and the driving roller 84. The fixing belt 82 rotates following the rotation of the heating roller 83 and the driving roller 84.

In the image forming apparatus shown in FIG. 9, the heating of the fixing belt 82 (Act 108) is performed as explained below. The CPU 40 drives the fuser driver 94 to energize lamp driving circuits 98 and cause the first and second halogen lamps 89 and 90 to emit light. The pressurizing roller 81 and the heating roller 83 are heated by the light emission of the first and second halogen lamps 89 and 90. The heat of the rollers 81 and 83 moves to the fixing belt 82, whereby the fixing belt 82 is heated.

In the image forming method shown in FIG. 9, the stop of the rotation of the fixing belt 82 (Act 112) is performed as explained below. The CPU 40 causes the fuser driver 94 to stop the rotation of the first and second driving motors 95 and 96 and stop the rotation of the heating roller 93 and the driving roller 94. The heating roller 93 and the driving roller 94 stop, whereby the rotation of the fixing belt 82 also stops.

In the fuser 80, the image forming apparatus, and the image forming method according to this embodiment explained above, as in the first embodiment, the second pressurizing pad 86*b* is provided to be movable between the position where the second pressurizing pad 86*b* presses the fixing belt 82 against the pressurizing roller 81 and the position where the second pressurizing pad 86*b* is separated from the fixing belt 82. The second pressurizing pad 86*b* is separated from the fixing belt 82 from power-on of the image forming apparatus until the temperature of the fixing belt 82 in the fuser 80 reaches the predetermined temperature (the warm-up ends). After the warm-up ends, the second pressurizing pad 86*b* is moved to press the fixing belt 82 against the pressurizing roller 81. Therefore, it is possible to reduce, without deteriorating fixing performance, time from power-on of the image forming apparatus until the warm-up ends.

Third Embodiment

An image forming apparatus and a fuser according to a third embodiment are explained below. The image forming apparatus according to the third embodiment is the same as the image forming apparatus 1 according to the first embodiment except the configuration of the fuser. Therefore, explanation of the image forming apparatus is omitted. The fuser according to the third embodiment is explained below.

Figure 12:
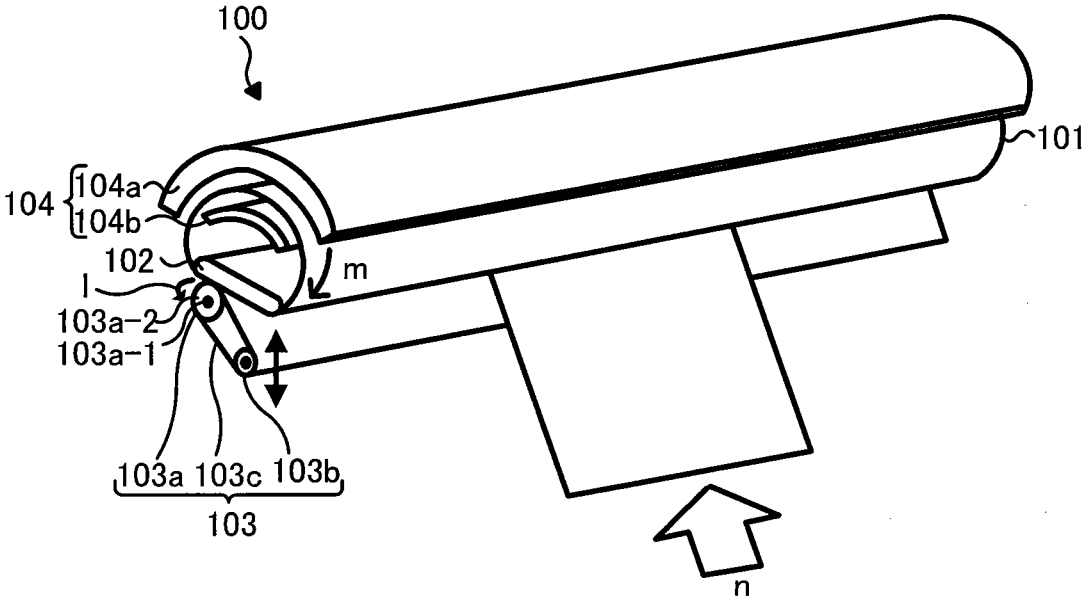
FIG. 12 is a perspective view of a main part of a fuser according to a third embodiment.

FIG. 12 is a perspective view of a main part of a fuser 100 according to the third embodiment. As shown in FIG. 12, the fuser 100 includes a fixing belt 101, a pressurized section 102, a nip forming section 103, and a heating unit 104.

The heating unit 104 includes an IH section 104*a* including an IH heating coil and a temperature sensitive magnetic body 104*b* and heats the fixing belt 101. The heating unit 104 and the fixing belt 101 are respectively provided in the same manner as the heating unit 63 and the fixing belt 60 provided in the fuser 30 according to the first embodiment.

The pressurized section 102 is a pressurized pad 102 provided in contact with a part of the inner circumference of the fixing belt 101. The pressurized pad 102 has length necessary for satisfying desired fixing performance. The pressurized pad 102 is made of an elastic body such as heat resistant silicon sponge or silicon rubber.

The nip forming section 103 forms a nip portion having desired length between the nip forming section 103 and the pressurized pad 102. The nip forming section 103 includes a pressurizing roller 103*a*, which is a first nip forming section 103*a*, a tension roller 103*b*, which is a second nip forming section 103*b*, and a pressurizing belt 103*c*.

The pressurizing roller 103*a* is a roller including an elastic layer 103*a*-2 formed of heat resistant silicon sponge, silicon rubber, or the like around, for example, a cored bar 103*a*-1 and including a release layer (not shown in the figure) formed of fluorine resin such as PFA resin on the surface of the elastic layer 103*a*-2. The pressurizing roller 103*a* is arranged, such that the longitudinal direction of the pressurizing roller 103*a* is parallel to the longitudinal direction of the fixing belt 101, in a position in contact with the outer circumference of the fixing belt 101 via the pressurizing belt 103*c* and a position where the pressurizing roller 103*a* can press the fixing belt 101 against one end of the pressurized pad 102 via the pressurizing belt 103*c*. A gear (not shown in the figure) provided at an end of the cored bar 103*a*-1 is rotated by a driving motor, whereby the pressurizing roller 103*a* rotates in an arrow 1 direction.

The tension roller 103*b* is a roller obtained by covering a cored bar made of, for example, SUS with a PFA tube. The tension roller 103*b* is arranged in the outer circumference of the fixing belt 101 such that the longitudinal direction of the tension roller 103*b* is parallel to the longitudinal direction of the fixing belt 101.

The pressurizing belt 103*c* is an endless belt and includes the pressurizing roller 103*a* and the tension roller 103*b* on the inside. The pressurizing belt 103*c* is stretched and suspended by the pressurizing roller 103*a* and the tension roller 103*b*.

The pressurizing belt 103*c* rotates in the arrow 1 direction following the rotation of the pressurizing roller 103*a*. The fixing belt 101 rotates in the arrow m direction following the rotation of the pressurizing belt 103*c*. The sheet P is conveyed in the arrow n direction according to the rotation of the pressurizing belt 103*c* and the rotation of the fixing belt 101.

Figure 13:
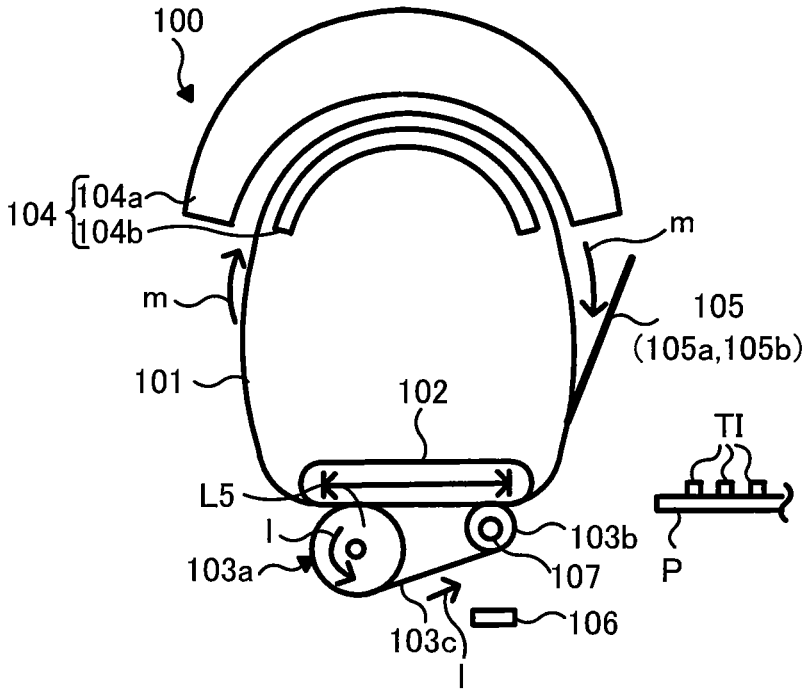
FIGS. 13A and 13B are sectional views of the fuser shown in FIG. 12.
Figure 13:
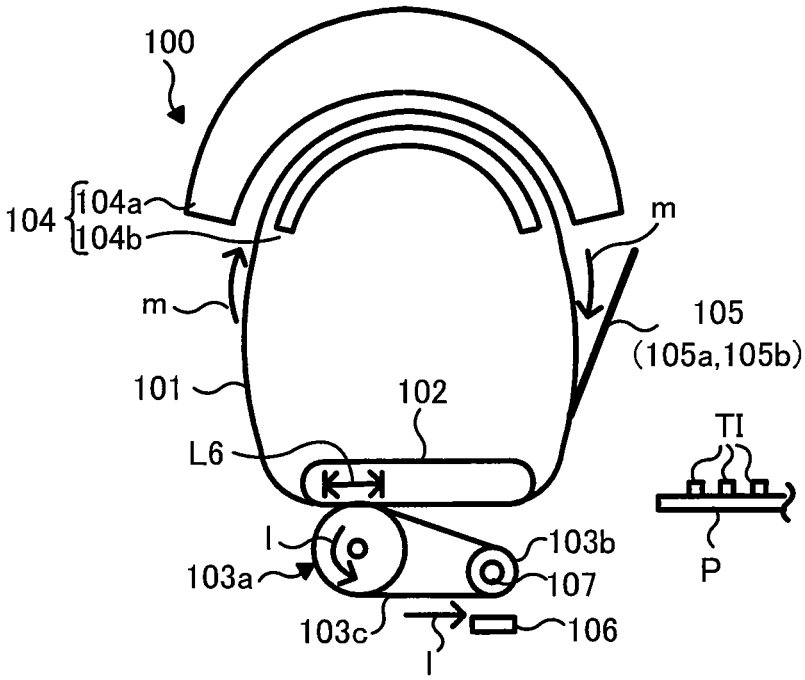

FIGS. 13A and 13B are sectional views of the fuser 100 shown in FIG. 12. As shown in FIGS. 13A and 13B, the pressurizing roller 103*a*, which is the first nip forming section 103*a*, is fixed in a position where the pressurizing roller 103*a* can press the fixing belt 101 against one end of the pressurized pad 102, which is the pressurized section 102, from the inside of the pressurizing belt 103*c* via the pressurizing belt 103*c*.

The tension roller 103*b*, which is the second nip forming section 103*b*, is provided to be movable between a position where the tension roller 103*b* can press the fixing belt 101 against the other end of the pressurized pad 102, which is the pressurized section 102, from the inside of the pressurizing belt 103*c* via the pressurizing belt 103*c* (FIG. 13A) and a position where the tension roller 103*b* is separated from the fixing belt 101 via the pressurizing belt 103*c* (FIG. 13B).

As shown in FIGS. 13A and 13B, the fuser 100 includes temperature sensors 105 and a position detection sensor 106.

The temperature sensors 105 include a center temperature sensor 105*a* for detecting the temperature of the center in the longitudinal direction of the fixing belt 101 and an end temperature sensor 105*b* for detecting the temperature of an end in the longitudinal direction of the fixing belt 101. The temperature sensors 105*a* and 105*b* are respectively thermistors of a contact type provided in contact with the fixing belt 101. The temperature sensors 105*a* and 105*b* are provided in an upstream portion of the fixing belt 101.

The position detection sensor 106 is a sensor for detecting the position of the tension roller 103*b* and is provided on the inside of the pressurizing belt 103*c*.

As shown in FIG. 13A, if the tension roller 103*b* is arranged in the position where the tension roller 103*b* can press the fixing belt 101 against the other end of the pressurized pad 102, which is the pressurized section 102, via the pressurizing belt 103*c*, the pressurizing belt 103*c* between the pressurizing roller 103*a* and the tension roller 103*b* is in contact with the fixing belt 101, which is in contact with the pressurized pad 102. As a result, a nip portion having nip width L5 is formed between the pressurizing belt 103*c* and the pressurized pad 102. The nip width L5 is length enough for satisfying the desired fixing performance.

As shown in FIG. 13B, if the tension roller 103*b* is arranged in the position where the tension roller 103*b* is separated from the fixing belt 101 via the pressurizing belt 103*c*, a nip portion may not be able to be formed at least between the tension roller 103*b* and the other end of the pressurized pad 102. A nip portion having nip width L6 is formed between the pressurizing roller 103*a* and one end of the pressurized pad 102. The nip width L6 is smaller than the nip width L5 shown in FIG. 13A.

The fuser 100 can change the nip width of the nip portion by moving the tension roller 103*b*.

On the inside of the tension roller 103*b*, a heat pipe 107 is provided in parallel to the longitudinal direction of the roller 103*b*. Therefore, if the heat distribution of the fixing belt 101 is non-uniform, the heat distribution of the fixing belt 101 can be uniformalized by arranging the tension roller 103*b* in the position shown in FIG. 13A.

Figure 14:
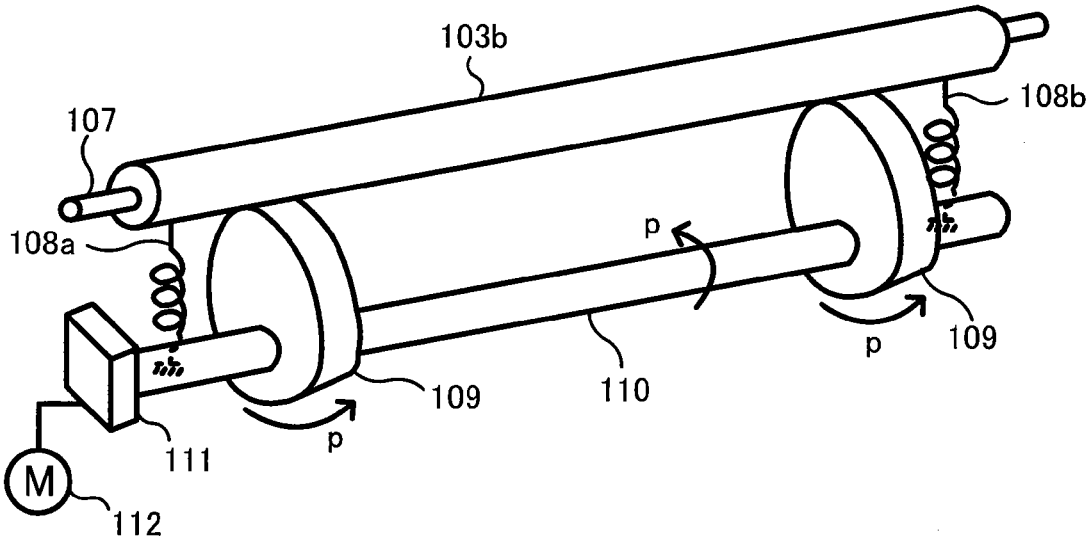
FIGS. 14A and 14B are diagrams of a moving mechanism that moves a second nip porting section.
Figure 14:
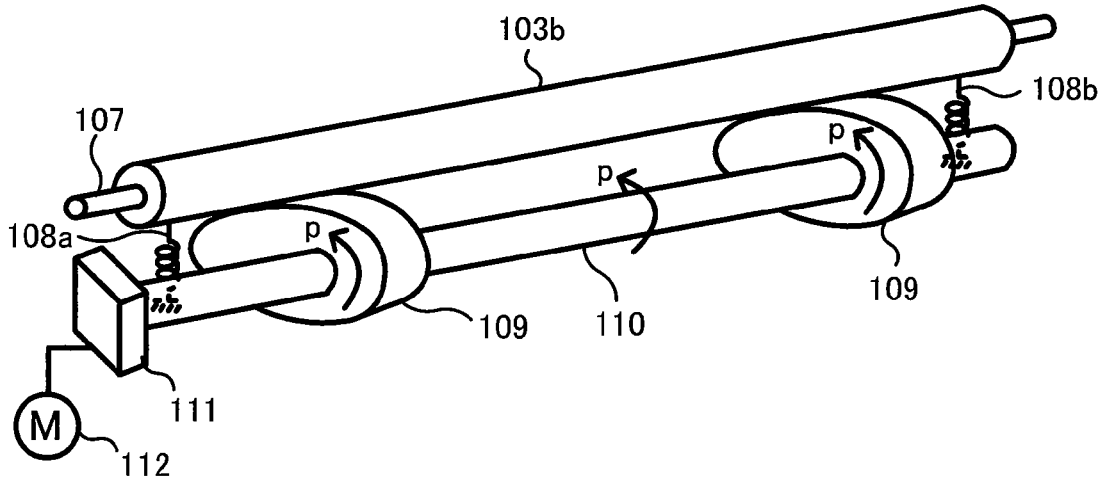

FIGS. 14A and 14B are diagrams of a moving mechanism that moves the tension roller 103*b*, which is the second nip forming section 103*b*. As shown in FIGS. 14A and 14B, the moving mechanism includes an elastic body 108 that supports the tension roller 103*b*, plural cams 109, and a cam supporting body 110 that pierces through the cams 109.

The elastic body 108 includes, for example, plural springs 108*a* and 108*b*. One ends of the respective springs 108*a* and 108*b* are fixed to the surface of the tension roller 103*b*. The other ends of the respective springs 108*a* and 108*b* are fixed in predetermined positions in the fuser 100. The tension roller 103*b* is supported from below by the springs 108*a* and 108*b*.

The plural cams 109 are formed in an elliptical shape. The cams 109 are fixed to the cam supporting body 110 arranged under the tension roller 103*b* in parallel to the longitudinal direction of the roller 103*b*. The respective cams 109 can rotate in an arrow p direction according to the rotation in the arrow p direction of the cam supporting body 110.

The cam supporting body 110 pierces through the cams 109 in positions decentered from the centers of the elliptical cams 109.

A gear section 111 for rotating the cam supporting body 110 is provided at an end of the cam supporting body 110. A nip forming section moving motor 112 is connected to the gear section 111. When the gear section 111 is driven to rotate by the motor 112, the cam supporting body 110 rotates in the arrow p direction and the cams 109 also rotates in the arrow p direction.

If the tension roller 103*b* presses the fixing belt 101 against the other end of the pressurized pad 102 via the pressurizing belt 103*c* (FIG. 13A), as shown in FIG. 14A, the cams 109 come into contact with the surface of the tension roller 103*b* and press the tension roller 103*b* upward (a direction in which the pressurizing pad 102 is arranged). In other words, the tension roller 103*b* presses the fixing belt 101 against the other end of the pressurized pad 102 with the cams 109.

If the tension roller 103*b* is separated from the fixing belt 101 via the pressurizing belt 103*c* (FIG. 13B), the cams 109 rotate in the arrow p direction until the state shown in FIG. 14A changes to the state shown in FIG. 14B. At this point, the tension roller 103*b* moves downward (a direction opposite to the direction in which the pressurized pad 102 is arranged) with the elastic force of the springs 108*a* and 108*b* and the own weight. In other words, the tension roller 103*b* separates from the fixing belt 101 with the elastic force of the springs 108*a* and 108*b* and the own weight.

In the fuser 100, from power-on of the image forming apparatus until the temperature of the fixing belt 101 reaches predetermined temperature (e.g., fixing temperature), as shown in FIG. 13B, the tension roller 103*b* is arranged in the position where the tension roller 103*b* is separated from the fixing belt 101. When the temperature of the fixing belt 101 reaches the predetermined temperature, as shown in FIG. 13A, the tension roller 103*b* moves to the position where tension roller 103*b* can press the fixing belt 101 against the other end of the pressurized pad 102 via the pressurizing belt 103*c*. The sheet P having the toner image TI formed thereon is conveyed to the fuser 100 in this state. When the sheet P reaches a nip portion between the fixing belt 101, which is in contact with the pressurized pad 102, and the pressurizing belt 103*c*, which is in contact with the fixing belt 101, the sheet P is conveyed to downstream of the fixing belt 101 while the toner image TI is heated and pressed. The toner image TI is fixed on the sheet P. The sheet P having the toner image TI fixed thereon is discharged from the fuser 100.

An image forming method by the image forming apparatus including the fuser 100 explained above is basically the same as the image forming method shown in FIG. 9. Therefore, detailed explanation of the image forming method by the image forming apparatus according to the third embodiment is omitted.

However, in the image forming method shown in FIG. 9, the determination whether the second nip forming section (the tension roller 103*b*) is separated from the fixing belt 101 (Act 105) is performed as explained below. The CPU 40 drives a fuser driver to detect the position of the tension roller 103*b* using the position detection sensor 106. The CPU 40 determines whether the position of the tension roller 103*b* is separated from the fixing belt 101.

The movement of the second nip forming section (the tension roller 103*b*) to the position where the tension roller 103*b* can press the fixing belt 101 against the pressurized section (the pressurized pad 102) (Act 103) is performed as explained below. The CPU 40 drives the fuser driver to rotate the nip forming section moving motor 112 and move the tension roller 103*b* such that the tension roller 103*b* presses the fixing belt 101 against the other end of the pressurized pad 102.

The movement of the second nip forming section (the tension roller 103*b*) to the position where the tension roller 103*b* is separated from the fixing belt 101 (Act 106) is performed as explained below. The CPU 40 drives the fuser driver to rotate the nip forming section moving motor 112 and move the tension roller 103*b* such that the tension roller 103*b* separates from the fixing belt 101.

In the fuser 100, the image forming apparatus, and the image forming method according to this embodiment explained above, as in the first and second embodiment, the tension roller 103*b* is provided to be movable between the position where the tension roller 103*b* can press the fixing belt 101 against the other end of the pressurized pad 102 and the position where the tension roller 103*b* is separated from the fixing belt 101. The tension roller 103*b* is separated from the fixing belt 101 from power-on of the image forming apparatus until the temperature of the fixing belt 101 in the fuser 100 reaches the predetermined temperature (warm-up ends). After the warm-up ends, the tension roller 103*b* is moved to the position where the tension roller 103*b* presses the fixing belt 101 against the other end of the pressurized pad 102. Therefore, it is possible to reduce, without deteriorating fixing performance, time from power-on of the image forming apparatus until the warm-up ends.

Fourth Embodiment

An image forming apparatus and a fuser according to a fourth embodiment are explained below. The image forming apparatus according to the fourth embodiment is the same as the image forming apparatus according to the third embodiment except the configuration of the fuser. Therefore, explanation of the image forming apparatus is omitted. The fuser according to the fourth embodiment is explained below.

Figure 15:
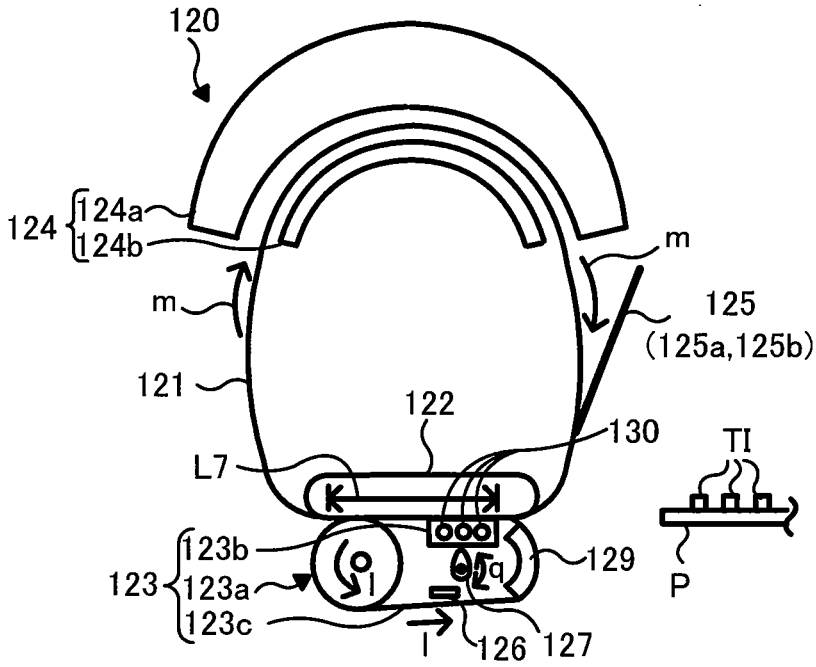
FIGS. 15A and 15B are sectional views of a fuser according to a fourth embodiment.
Figure 15:
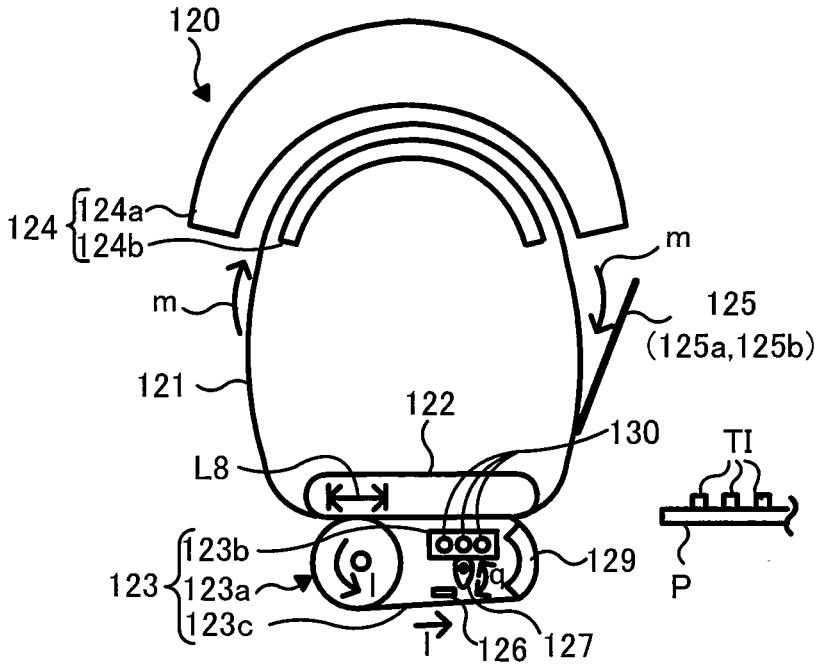

FIGS. 15A and 15B are sectional views of the fuser according to the fourth embodiment. As shown in FIGS. 15A and 15B, a fuser 120 includes a fixing belt 121, a pressurized section 122, which is a pressurized pad 122, a nip forming section 123, a heating unit 124 including an IH section 124*a* and a temperature sensitive magnetic body 124*b*, temperature sensors 125 including a center temperature sensor 125*a* and an end temperature sensor 125*b*, and a position detection sensor 126. The fixing belt 121, the pressurized section 122, which is the pressurized pad 122, the heating unit 124 including the IH section 124*a* and the temperature sensitive magnetic body 124*b*, the temperature sensors 125 including the center temperature sensor 125*a* and the end temperature sensor 125*b*, and the position detection sensor 126 are respectively provided in the same manner as those in the fuser 100 according to the third embodiment.

In the fuser 120 according to the fourth embodiment, the nip forming section 123 forms a nip portion having desired length between the nip forming section 123 and the pressurized pad 122. The nip forming section 123 includes a pressurizing roller 123*a*, which is a first nip forming section 123*a*, a pressurizing pad 123*b*, which is a second nip forming section 123*b*, and a pressurizing belt 123*c*.

The pressurizing roller 123*a* is provided in the same manner as the pressurizing roller 103*a* provided in the fuser 100 according to the third embodiment.

The pressurizing pad 123*b* is configured in the same manner as the pressurized pad 122 except that length is different. The pressurizing pad 123*b* is arranged in the outer circumference of the fixing belt 101 such that the longitudinal direction of the pressurizing pad 123*b* is parallel to the longitudinal direction of the fixing belt 101.

The pressurizing pad 123*b* is provided to be movable between a position where the pressurizing pad 123*b* can press the fixing belt 121 against the other end of the pressurized pad 122, which is the pressurized section 122, via the pressurizing belt 123*c* from the inside of the pressurizing belt 123*c* (FIG. 15A) and a position where the pressurizing pad 123*b* is separated from the fixing belt 121 via the pressurizing belt 123*c* (FIG. 15B).

The pressurizing pad 123*b* can be moved between the position shown in FIG. 15A and the position shown in FIG. 15B according to the rotation in an arrow q direction of cams 127. The cam 127 can be rotated in the arrow q direction by configuring, for example, a moving mechanism same as that shown in FIGS. 14A and 14B using a nip forming section moving motor.

The pressurizing belt 123*c* is an endless belt. The pressurizing belt 123*c* includes the pressurizing roller 123*a*, the pressurizing pad 123*b*, and a belt guide 127. The pressurizing belt 123*c* is stretched and suspended by the pressurizing roller 123*a* and the belt guide 127.

The pressurizing belt 123*c* rotates in the arrow 1 direction following the rotation in the arrow 1 direction of the pressurizing roller 123*a*. The fixing belt 121 rotates in the arrow m direction following the rotation of the pressurizing belt 123*c*.

As shown in FIG. 15A, if the pressurizing pad 123*b* is arranged in the position where the pressurizing pad 123*b* can press the fixing belt 121 against the other end of the pressurized pad 122, which is the pressurized section 122, via the pressurizing belt 123, the pressurizing belt 123*c* between the pressurizing roller 123*a* and the pressurizing pad 123*b* comes into contact with the fixing belt 121, which is in contact with the pressurized pad 122. As a result, a nip portion having nip width L7 is formed between the pressurizing belt 123*c* and the pressurized pad 122. The nip width L7 is length enough for satisfying desired fixing performance.

As shown in FIG. 15B, if the pressurizing pad 123*b* is arranged in the position where the pressurizing pad 123*b* is separated from the fixing belt 121 via the pressurizing belt 123*c*, a nip portion may not be able to be formed at least between the pressurizing pad 123*b* and one end of the pressurized pad 122. A nip portion having nip width L8 is formed between the pressurizing roller 123*a* and the pressurized pad 122. The nip width L8 is smaller than the nip width L7 shown in FIG. 15A.

In other words, the fuser 120 can change the nip width of the nip portion by moving the pressurizing pad 123*b*.

On the inside of the pressurizing pad 123*b*, heat pipes 130 are provided in parallel to the longitudinal direction of the pad 123*b*. Therefore, if the heat distribution of the fixing belt 121 is non-uniform, the heat distribution of the fixing belt 121 can be uniformalized by arranging the pressurizing pad 123*b* in the position shown in FIG. 15A.

In the fuser 120, from power-on of the image forming apparatus until the temperature of the fixing belt 121 reaches predetermined temperature (e.g., fixing temperature), as shown in FIG. 15B, the pressurizing pad 123*b* is arranged in the position where the pressurizing pad 123*b* is separated from the fixing belt 121. When the temperature of the fixing belt 121 reaches the predetermined temperature, as shown in FIG. 15A, the pressurizing pad 123*b* moves to the position where the pressurizing pad 123*b* can press the fixing belt 121 against the other end of the pressurized pad 122 via the pressurizing belt 123*c*. The sheet P having the toner image TI formed thereon is conveyed to the fuser 120 in this state. When the sheet P reaches a nip portion between the fixing belt 121, which is in contact with the pressurized pad 122, and the pressurizing belt 123*c*, which is in contact with the fixing belt 121, the sheet P is conveyed to downstream of the fixing belt 121 while the toner image TI is heated and pressed. The toner image TI is fixed on the sheet P. The sheet P having the toner image TI fixed thereon is discharged from the fuser 120.

An image forming method by the image forming apparatus including the fuser 120 explained above is basically the same as the image forming method shown in FIG. 9. Therefore, detailed explanation of the image forming method by the image forming apparatus according to the fourth embodiment is omitted.

However, in the image forming method shown in FIG. 9, the determination whether the second nip forming section (the pressurizing pad 123*b*) is separated from the fixing belt 121 (Act 105) is performed as explained below. The CPU 40 drives a fuser driver to detect the position of the pressurizing pad 123*b* using the position detection sensor 126. The CPU 40 determines whether the position of the pressurizing pad 123*b* is separated from the fixing belt 121.

The movement of the second nip forming section (the pressurizing pad 123*b*) to the position where the pressurizing pad 123*b* can press the fixing belt 121 against the pressurized section (the pressurized pad 122) (Act 103) is performed as explained below. The CPU 40 drives the fuser driver to rotate the nip forming section moving motor and move the pressurizing pad 123*b* such that the pressurizing pad 123*b* presses the fixing belt 121 against the other end of the pressurized pad 122.

The movement of the second nip forming section (the pressurizing pad 123*b*) to the position where the pressurizing pad 123*b* is separated from the fixing belt 121 (Act 106) is performed as explained below. The CPU 40 drives the fuser driver to rotate the nip forming section moving motor and move the pressurizing pad 123*b* such that the pressurizing pad 123*b* separates from the fixing belt 121.

In the fuser 120, the image forming apparatus, and the image forming method according to this embodiment explained above, as in the first to third embodiment, the pressurizing pad 123*b* is provided to be movable between the position where the pressurizing pad 123*b* can press the fixing belt 121 against the other end of the pressurized pad 122 and the position where the pressurizing pad 123*b* is separated from the fixing belt 121. The pressurizing pad 123*b* is separated from the fixing belt 121 from power-on of the image forming apparatus until the temperature of the fixing belt 121 in the fuser 120 reaches the predetermined temperature (warm-up ends). After the warm-up ends, the pressurizing pad 123*b* is moved to the position where the pressurizing pad 123*b* presses the fixing belt 121 against the other end of the pressurized pad 122. Therefore, it is possible to reduce, without deteriorating fixing performance, time from power-on of the image forming apparatus until the warm-up ends.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A fuser comprising:

a cylindrical fixing belt;

a heating unit configured to heat the fixing belt;

a pressurized section arranged in contact with the fixing belt;

a first nip forming section fixed in a position where the first nip forming section presses the fixing belt against the pressurized section;

a second nip forming section movable between a first position in which the second nip forming section presses the fixing belt against the pressurized section and a second position in which the second nip forming section is separated from the fixing belt;

a moving mechanism configured to move the second nip forming section between the first position and the second position; and a fuser driver configured to control the moving mechanism based on a temperature of the fixing belt, so that the second nip forming section is moved to the second position when the temperature of the fixing belt is lower than a predetermined temperature and the second nip forming section is at the first position, and the second nip forming section is moved to the first position after the temperature of the fixing belt is equal to or exceeds the predetermined temperature and the second nip forming section is at the second position.

2. The fuser according to claim 1, wherein the pressurized section is a rotating pressurizing roller arranged in contact with a part of an outer circumference of the fixing belt, the first nip forming section is a first pressurizing pad arranged on an inside of the fixing belt and fixed in a position where the first pressurizing pad presses the fixing belt against the pressurizing roller from the inside of the fixing belt, the second nip forming section is a second pressurizing pad arranged on the inside of the fixing belt and configured to be movable between the first position where the second pressurizing pad presses the fixing belt against the pressurizing roller from the inside of the fixing belt and the second position, and the fixing belt rotates in conjunction with the rotation of the pressurizing roller.

3. The fuser according to claim 2, wherein the second pressurizing pad includes a heat pipe.

4. The fuser according to claim 1, wherein the pressurized section is a pressurizing roller arranged in contact with a part of an outer circumference of the fixing belt, the first nip forming section is a first pressurizing pad arranged on an inside of the fixing belt and fixed in a position where the first pressurizing pad presses the fixing belt against the pressurizing roller from the inside of the fixing belt, the second nip forming section is a second pressurizing pad arranged on the inside of the fixing belt and configured to be movable between a position where the second pressurizing pad presses the fixing belt against the pressurizing roller from the inside of the fixing belt and a position where the second pressurizing pad is separated from the fixing belt, the fuser further comprises:

a heating roller arranged in a position where the heating roller is separated from the pressurizing roller, including the heating unit on an inside, and configured to rotate;

a driving roller arranged in a position where the driving roller is separated from the pressurizing roller and the heating roller and configured to rotate; and a tension roller arranged in a position where the tension roller is separated from the pressurizing roller, the heating roller, and the driving roller, and the fixing belt is stretched and suspended by the heating roller, the driving roller, and the tension roller and configured to rotate following the rotation of the heating roller and the driving roller.

5. The fuser according to claim 4, wherein the second pressurizing pad includes a heat pipe.

6. The fuser according to claim 1, wherein the pressurized section is a pressurized pad arranged in contact with a part of an inner circumference of the fixing belt, the first nip forming section is a pressurizing roller fixed in a position where the pressurizing roller can press the fixing belt against one end of the pressurized pad and configured to rotate, the second nip forming section is a tension roller configured to be movable between a position where the tension roller presses the fixing belt against the other end of the pressurized pad and a position where the tension roller is separated from the fixing belt, the fuser further comprises a pressurizing belt arranged such that a part thereof is in contact with the fixing belt, stretched and suspended by the pressurizing roller and the tension roller, and configured to rotate following the rotation of the pressurizing roller, and the fixing belt rotates following the rotation of the pressurizing belt.

7. The fuser according to claim 6, wherein the tension roller includes a heat pipe.

8. The fuser according to claim 1, wherein the pressurized section is a pressurized pad arranged in contact with a part of an inner circumference of the fixing belt, the first nip forming section is a pressurizing roller fixed in a position where the pressurizing roller can press the fixing belt against one end of the pressurized pad and configured to rotate, the second nip forming section is a pressurizing pad configured to be movable between a position where the pressurizing pad presses the fixing belt against the other end of the pressurized pad and a position where the pressurizing pad is separated from the fixing belt, the fuser further comprises:

a belt guide provided in a position where the fixing belt is arranged between the belt guide and the other end of the pressurized pad; and a pressurizing belt arranged such that apart thereof is in contact with the fixing belt, stretched and suspended by the pressurizing roller and the belt guide, and configured to rotate following the rotation of the pressurizing roller, and the fixing belt rotates following the rotation of the pressurizing belt.

9. The fuser according to claim 8, wherein the pad includes a heat pipe.

10. An image forming apparatus comprising:

an image forming section configured to form a toner image on a recording medium;

a cylindrical fixing belt arranged in contact with the toner image;

a heating unit configured to heat the fixing belt;

a pressurized section arranged in contact with the fixing belt;

a first nip forming section fixed in a position where the first nip forming section presses the fixing belt against the pressurized section;

a second nip forming section movable between a first position in which the second nip forming section presses the fixing belt against the pressurized section and a second position in which the second nip forming section is separated from the fixing belt;

a moving mechanism configured to move the second nip forming section between the first position and the second position; and a fuser driver configured to control the moving mechanism based on a temperature of the fixing belt, so that the second nip forming section is moved to the second position when the temperature of the fixing belt is lower than a predetermined temperature and the second nip forming section is at the first position, and the second nip forming section is moved to the first position after the temperature of the fixing belt is equal to or exceeds the predetermined temperature and the second nip forming section is at the second position.

11. The image forming apparatus according to claim 10, wherein the pressurized section is a rotating pressurizing roller arranged in contact with a part of an outer circumference of the fixing belt, the first nip forming section is a first pressurizing pad arranged on an inside of the fixing belt and fixed in a position where the first pressurizing pad can press the fixing belt against the pressurizing roller from the inside of the fixing belt, the second nip forming section is a second pressurizing pad arranged on the inside of the fixing belt and configured to be movable between the first position where the second pressurizing pad presses the fixing belt against the pressurizing roller from the inside of the fixing belt and the second position, and the fixing belt rotates in conjunction with the rotation of the pressurizing roller.

12. The image forming apparatus according to claim 10, wherein the pressurized section is a rotating pressurizing roller arranged in contact with a part of an outer circumference of the fixing belt, the first nip forming section is a first pressurizing pad arranged on an inside of the fixing belt and fixed in a position where the first pressurizing pad can press the fixing belt against the pressurizing roller from the inside of the fixing belt, the second nip forming section is a second pressurizing pad arranged on the inside of the fixing belt and configured to be movable between a position where the second pressurizing pad presses the fixing belt against the pressurizing roller from the inside of the fixing belt and a position where the second pressurizing pad is separated from the fixing belt, the apparatus further comprises:

a heating roller arranged in a position where the heating roller is separated from the pressurizing roller, including the heating unit on an inside, and configured to rotate;

a driving roller arranged in a position where the driving roller is separated from the pressurizing roller and the heating roller and configured to rotate; and a tension roller arranged in a position where the tension roller is separated from the pressurizing roller, the heating roller, and the driving roller, and the fixing belt is stretched and suspended by the heating roller, the driving roller, and the tension roller and configured to rotate following the rotation of the heating roller and the driving roller.

13. The image forming apparatus according to claim 10, wherein the pressurized section is a pressurized pad arranged in contact with a part of an inner circumference of the fixing belt, the first nip forming section is a pressurizing roller fixed in a position where the pressurizing roller can press the fixing belt against one end of the pressurized pad and configured to rotate, the second nip forming section is a tension roller configured to be movable between a position where the tension roller presses the fixing belt against the other end of the pressurized pad and a position where the tension roller is separated from the fixing belt, the fuser further comprises a pressurizing belt arranged such that a part thereof is in contact with the fixing belt, stretched and suspended by the pressurizing roller and the tension roller, and configured to rotate following the rotation of the pressurizing roller, and the fixing belt rotates following the rotation of the pressurizing belt.

14. The image forming apparatus according to claim 10, wherein the pressurized section is a pressurized pad arranged in contact with a part of an inner circumference of the fixing belt, the first nip forming section is a pressurizing roller fixed in a position where the pressurizing roller can press the fixing belt against one end of the pressurized pad and configured to rotate, the second nip forming section is a pressurizing pad configured to be movable between a position where the pressurizing pad presses the fixing belt against the other end of the pressurized pad and a position where the pressurizing pad is separated from the fixing belt, the fuser further comprises:

a belt guide provided in a position where the fixing belt is arranged between the belt guide and the other end of the pressurized pad; and a pressurizing belt arranged such that a part thereof is in contact with the fixing belt, stretched and suspended by the pressurizing roller and the belt guide, and configured to rotate following the rotation of the pressurizing roller, and the fixing belt rotates following the rotation of the pressurizing belt.

15. An image forming method comprising:

positioning a second nip forming section at a second position in which the second nip forming section is separated from a fixing belt when a temperature of the fixing belt pressed against a pressed section by a first nip forming section is lower than a predetermined temperature, the second nip forming section being movable between a first position where the second nip forming section presses the fixing belt against the pressurized section and the second position;

heating the fixing belt to a temperature equal to or higher than the predetermined temperature in a state in which the second nip forming section is separated from the fixing belt;

moving the second nip forming section based on the temperature of the fixing belt so that the second nip forming section is moved from the second position to the first position to form a nip portion between the pressurized section and the first and second nip forming sections, after the temperature of the fixing belt is equal to or higher than the predetermined temperature;

forming a toner image on a recording medium; and causing the recording medium having the toner image formed thereon to pass through the nip portion and fixing the toner image on the recording medium.

* * * * *